US008925474B2

(12) United States Patent
Landoni

(10) Patent No.: US 8,925,474 B2
(45) **Date of Patent: *Jan. 6, 2015**

(54) MACHINE AND METHOD FOR SEWING, EMBROIDERING, QUILTING AND/OR THE LIKE

(76) Inventor: Alberto Landoni, Fagnano (IT)

( * ) Notice: Subject to any disclaimer, the term of this patent is extended or adjusted under 35 U.S.C. 154(b) by 1178 days.

This patent is subject to a terminal disclaimer.

(21) Appl. No.: 12/826,926

(22) Filed: Jun. 30, 2010

(65) Prior Publication Data

US 2011/0000413 A1 Jan. 6, 2011

Related U.S. Application Data

(60) Provisional application No. 61/222,365, filed on Jul. 1, 2009.

(51) Int. Cl.

| | |
|---|---|
| ***D05B 23/00*** | (2006.01) |
| ***D05B 1/24*** | (2006.01) |
| ***D05B 55/08*** | (2006.01) |
| ***D05B 55/14*** | (2006.01) |

(52) U.S. Cl.

CPC *D05B 55/14* (2013.01); *D05B 1/24* (2013.01); *D05B 55/08* (2013.01)

USPC ..... 112/470.13

(58) Field of Classification Search

USPC ..... 112/163, 165, 176, 177, 162, 175.24, 112/198, 470.11, 470.13, 470.05, 470.06, 112/475.24, 475.17

See application file for complete search history.

(56) References Cited

U.S. PATENT DOCUMENTS

| | | | | |
|---|---|---|---|---|
| 3,347,190 | A * | 10/1967 | Roth | 112/176 |
| 3,680,507 | A | 8/1972 | Landoni | |
| 3,722,438 | A * | 3/1973 | Schinzel et al. | 112/199 |
| 4,089,281 | A | 5/1978 | Landoni | |
| 4,106,417 | A | 8/1978 | Landoni | |
| 4,262,613 | A | 4/1981 | Landoni | |
| 4,501,208 | A | 2/1985 | Landoni | |
| 4,531,467 | A * | 7/1985 | Golia, Jr. et al. | 112/155 |
| 5,005,499 | A | 4/1991 | Landoni | |
| 5,269,238 | A | 12/1993 | Landoni | |
| 5,676,077 | A | 10/1997 | Landoni | |
| 5,967,068 | A | 10/1999 | Landoni | |
| 6,470,814 | B2 * | 10/2002 | Keilmann | 112/176 |
| 6,957,615 | B1 | 10/2005 | Landoni | |
| 7,591,227 | B2 | 9/2009 | Landoni | |
| 2008/0245283 | A1 | 10/2008 | Landoni | |
| 2009/0126611 | A1 | 5/2009 | Landoni | |
| 2009/0301370 | A1 | 12/2009 | Landoni | |

* cited by examiner

*Primary Examiner* — Tejash Patel

(74) *Attorney, Agent, or Firm* — Greenberg Traurig, LLP

(57) ABSTRACT

One embodiment of the present invention relates to a machine for sewing, embroidering, quilting and/or the like. Another embodiment of the present invention relates to a method for sewing, embroidering, quilting and/or the like. In one example, the present invention may be applied (e.g., as a machine and/or method) to a multi-needle machine or method. In another example, the present invention may provide for automatic lower (or bottom) thread cutting. In another example, the present invention may provide for automatic lower (or bottom) thread cutting by utilizing the phase (that is, movement phase) of a return of a looper (or hook) to cut the lower (or bottom) thread.

9 Claims, 38 Drawing Sheets

| NEEDLES POSITION | NEEDLE ROWS | WORKING WIDTH | CARRIAGE STROKE | STANDARD FEET | STICH LENGTH | WORKING SPEED |
|---|---|---|---|---|---|---|
| 100x3 1"PITCH | 3 3"–6" | cm.254 (100")+ cm.30 (12") | mm 305 12" | 64 1" | 1–6 mm | UP TO 1400 spm |

MACHINE AND METHOD FOR SEWING, EMBROIDERING, QUILTING AND/OR THE LIKE

RELATED APPLICATIONS

This application claims the benefit of U.S. Provisional Application Ser. No. 61/222,365, filed Jul. 1, 2009. The aforementioned application is incorporated herein by reference in its entirety.

FIELD OF THE INVENTION

One embodiment of the present invention relates to a machine for sewing, embroidering, quilting and/or the like.

Another embodiment of the present invention relates to a method for sewing, embroidering, quilting and/or the like.

In one example, the present invention may be applied (e.g., as a machine and/or method) to a multi-needle machine or method.

In another example, the present invention may provide for automatic lower (or bottom) thread cutting.

In another example, the present invention may provide for automatic lower (or bottom) thread cutting by utilizing the phase (that is, movement phase) of a return of a looper (or hook) to cut the lower (or bottom) thread.

For the purposes of describing and claiming the present invention, the term "looper" (or "hook") is intended to refer to a mechanism of the type disclosed herein and is intended to be different from a known "rotary hook" (or "rotary hook assembly").

Of note, while various embodiments of the present invention are described herein, it is to be understood that the present invention may be applied to any desired type of machine and/or method (for example, the machine or method does not necessarily need to utilize curved needles (although such curved needles may, of course, be utilized); further the machine or method does not necessarily need to utilize independent needle bars (although such independent needle bars may, of course, be utilized)). In one example, the present invention may be applied to any desired type of quilting machine and/or method. In another example, the present invention may be applied to any desired type of machine and/or method using double chain stitch. In another example, the present invention may be applied to any desired type of quilting machine and/or method using double chain stitch.

BACKGROUND OF THE INVENTION

Various machines for quilting, stitching and the like have been disclosed in various patent-related documents. Examples include the following: U.S. Pat. No. 3,680,507, issued Aug. 1, 1972 to Landoni (entitled "MULTINEEDLE QUILTING MACHINE"); U.S. Pat. No. 4,089,281, issued May 16, 1978 to Landoni (entitled "CONTROL DEVICE OF A NEEDLE-BEARING IN A QUILTING MACHINE"); U.S. Pat. No. 4,106,417, issued Aug. 15, 1978 to Landoni (entitled "APPARATUS FOR CONTROLLING THE MOVEMENT OF A FABRIC-SUPPORTING CARRIAGE IN A QUILTING MACHINE"); U.S. Pat. No. 4,262,613, issued Apr. 21, 1981 to Landoni (entitled "APPARATUS FOR CONTROLLING THE TRANSVERSE MOVEMENT OF A FABRIC SUPPORTING CARRIAGE IN A QUILTING MACHINE"); U.S. Pat. No. 4,501,208, issued Feb. 26, 1985 to Landoni (entitled "PROCESS FOR THE BIDIRECTIONAL FEEDING OF FABRICS IN QUILTING MACHINES, AND A MACHINE UTILIZING THIS PROCESS"); U.S. Pat. No. 5,005,499, issued Apr. 9, 1991 to Landoni (entitled "DEVICE FOR DISABLING AND ENABLING STITCHING NEEDLES IN A QUILTING MACHINE OR A MULTI-NEEDLE EMBROIDERY MACHINE"); U.S. Pat. No. 5,269,238, issued Dec. 14, 1993 to Landoni (entitled "QUILTING MACHINE LOOPERS WITH LINKAGE/PISTON DRIVEN THREAD CUTTERS"); U.S. Pat. No. 5,676,077, issued Oct. 14, 1997 to Landoni (entitled "MULTI-NEEDLE CHAIN STITCH SEWING MACHINE WITH THREAD SEVERING SYSTEM"); U.S. Pat. No. 5,967,068, issued Oct. 19, 1999 to Landoni (entitled "MULTI-NEEDLE KNOTTED-STITCH QUILTING MACHINE WITH LOWER STITCHING ELEMENTS HAVING ROTATING HOOKS"); U.S. Pat. No. 6,957,615, issued Oct. 25, 2005 to Landoni (entitled "METHOD AND DEVICE TO APPLY CORD THREAD OR RIBBONS ONTO FABRICS IN A QUILTING MACHINE"); U.S. Patent Publication 2008/0245283, published Oct. 9, 2008 in the name of Landoni (entitled "AUTOMATIC MULTI-FUNCTION MULTI-NEEDLE SEWING MACHINE, AND RELATIVE SEWING METHOD"); and U.S. Pat. No. 7,591,227, issued Sep. 22, 2009 to Landoni (entitled "SYSTEMS AND METHODS FOR THREAD HANDLING AND/OR CUTTING").

SUMMARY OF THE INVENTION

In one embodiment, the present invention relates to a machine for making double chain stitches in a material, the double chain stitches being made using at least one upper thread and at least one lower thread, the machine comprising: at least one needle bar; a plurality of needles, wherein the needle bar has attached thereto the plurality of needles and wherein each needle brings the at least one upper thread from above the material to below the material; and at least one arm wherein the arm having a first end and a second end, the first end of the arm being connected to a drive train and the second end of the arm having attached thereto the needle bar; wherein the arm is sufficiently designed such that the second end of the arm moves along a path forming an arc; and wherein each of the plurality of needles is elongated along a long axis and wherein each of the plurality of needles is curved along the long axis.

In another embodiment, the present invention further includes a machine wherein each needle oscillate as each needle brings the upper thread from above the material to below the material.

In another embodiment, the present invention further includes a machine comprising a plurality of loopers disposed below the material sufficiently designed to manipulate the lower thread to form double chain stitches in combination with the upper thread; wherein each looper sufficiently designed to cut the lower thread with at least one cutting element associated with each looper; and wherein each looper oscillates as the looper manipulates the lower thread to form double chain stitches in combination with the upper thread.

In another embodiment, the present invention further includes a machine wherein the cutting element comprises a knife edge.

In another embodiment, the present invention further includes a machine wherein the looper comprises a leading end extending from a neck portion, and wherein the cutting element of the looper is disposed in a direction extending from the neck away from the leading end.

In another embodiment, the present invention further includes a machine wherein the cutting element of the looper is disposed in a direction extending approximately 180 degrees away from the leading end.

In another embodiment, the present invention further includes a machine wherein the cutting element is attached to the looper.

In another embodiment, the present invention further includes a machine wherein the cutting element is integral with the looper.

In another embodiment, the present invention further includes a machine having at least a first and second needle bar, wherein each needle bar is independently moved.

In yet another embodiment, the present invention relates to a method for making double chain stitches in a material, the double chain stitches being made using a plurality of upper threads and a plurality of lower threads, the method comprising: providing the material to receive the double chain stitches; utilizing a plurality of needles, each needle bringing one of the upper threads from above the material to below the material; utilizing a plurality of loopers disposed below the material, wherein each looper is used to manipulate one of the lower threads to form double chain stitches in combination with a respective one of the upper threads; and utilizing the plurality of loopers to cut each respective lower thread with at least one cutting element associated with each of the loopers.

BRIEF DESCRIPTION OF THE DRAWINGS

(FIGS. 11 and 12 show loopers (or hooks) at two different phases of movement and FIG. 13 shows certain details of a looper (or hook) of FIGS. 11 and 12).

Figure 1A:
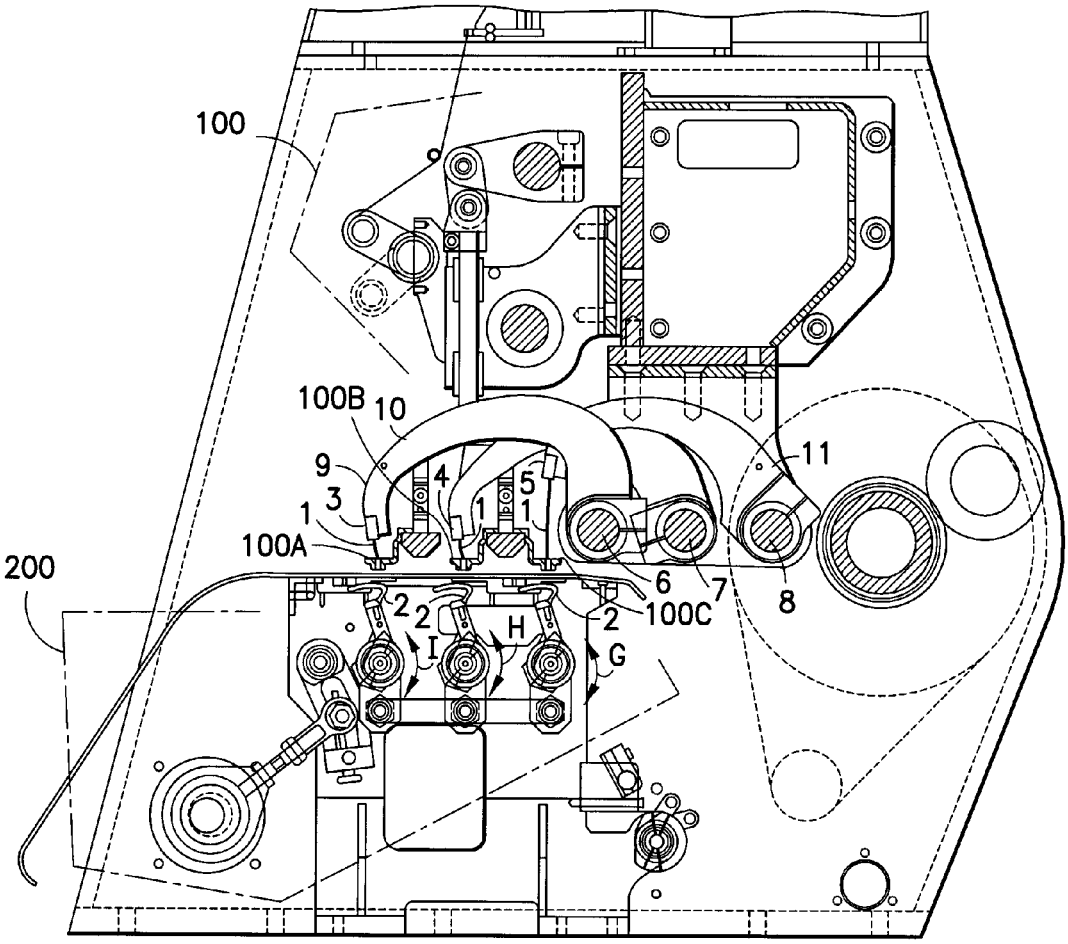
FIG. 1A shows a cross-sectional side view of a machine according to an embodiment of the present invention.

Among those benefits and improvements that have been disclosed, other objects and advantages of this invention will become apparent from the following description taken in conjunction with the accompanying figures. The figures constitute a part of this specification and include illustrative embodiments of the present invention and illustrate various objects and features thereof.

DETAILED DESCRIPTION OF THE INVENTION

Detailed embodiments of the present invention are disclosed herein; however, it is to be understood that the disclosed embodiments are merely illustrative of the invention that may be embodied in various forms. In addition, each of the examples given in connection with the various embodiments of the invention is intended to be illustrative, and not restrictive. Further, the figures are not necessarily to scale, some features may be exaggerated to show details of particular components (and any data, size, material and similar details shown in the figures are, of course, intended to be illustrative and not restrictive). Therefore, specific structural and functional details disclosed herein are not to be interpreted as limiting, but merely as a representative basis for teaching one skilled in the art to variously employ the present invention.

Of note, the application contains material that is subject to copyright protection. The copyright owner has no objection to the facsimile reproduction by anyone of the copyrighted material, as it appears in the Patent and Trademark Office file or records, but otherwise reserves all copyright rights whatsoever.

As described herein, in one embodiment the present invention may provide a multi-needle machine utilizing curved needles and/or independent movement of the needle bars.

Further, as described herein, in one example the present invention may be distinguished from certain conventional systems that, due to considerable inertia of the moving parts (and their complexity) present in such conventional systems, have various shortcomings, including (but not limited to):

Relatively limited sewing speed

Relatively high wear associated with sliding parts

Impossible to control independently a plurality of needle bars

Relatively high cost due to quantity and complexity of components

Further, as described herein, in another embodiment the present invention may provide a multi-needle double chain stitch quilting machine in which the sewing needles are curved to fit a semicircular, oscillating-alternating movement of the needle bars.

Further, as described herein, in another embodiment the present invention may provide a machine that allows for higher sewing speed due (at least in part) to the lower inertia of the moving parts.

Further, as described herein, in another embodiment the present invention may provide a machine that allows independent control of two, three (or more) needle bars such that certain patterns (e.g., sewing patterns) that are typically impossible (or very difficult) to accomplish on certain conventional machines (e.g., without independently movable needle bars such that all needle bars are in movement) may be produced (e.g., produced relatively easily using an embodiment of the present invention).

Further, as described herein, in another embodiment the present invention may provide a machine that has reduced manufacturing costs.

Reference will now be made to the Figs.

Figure 1B:
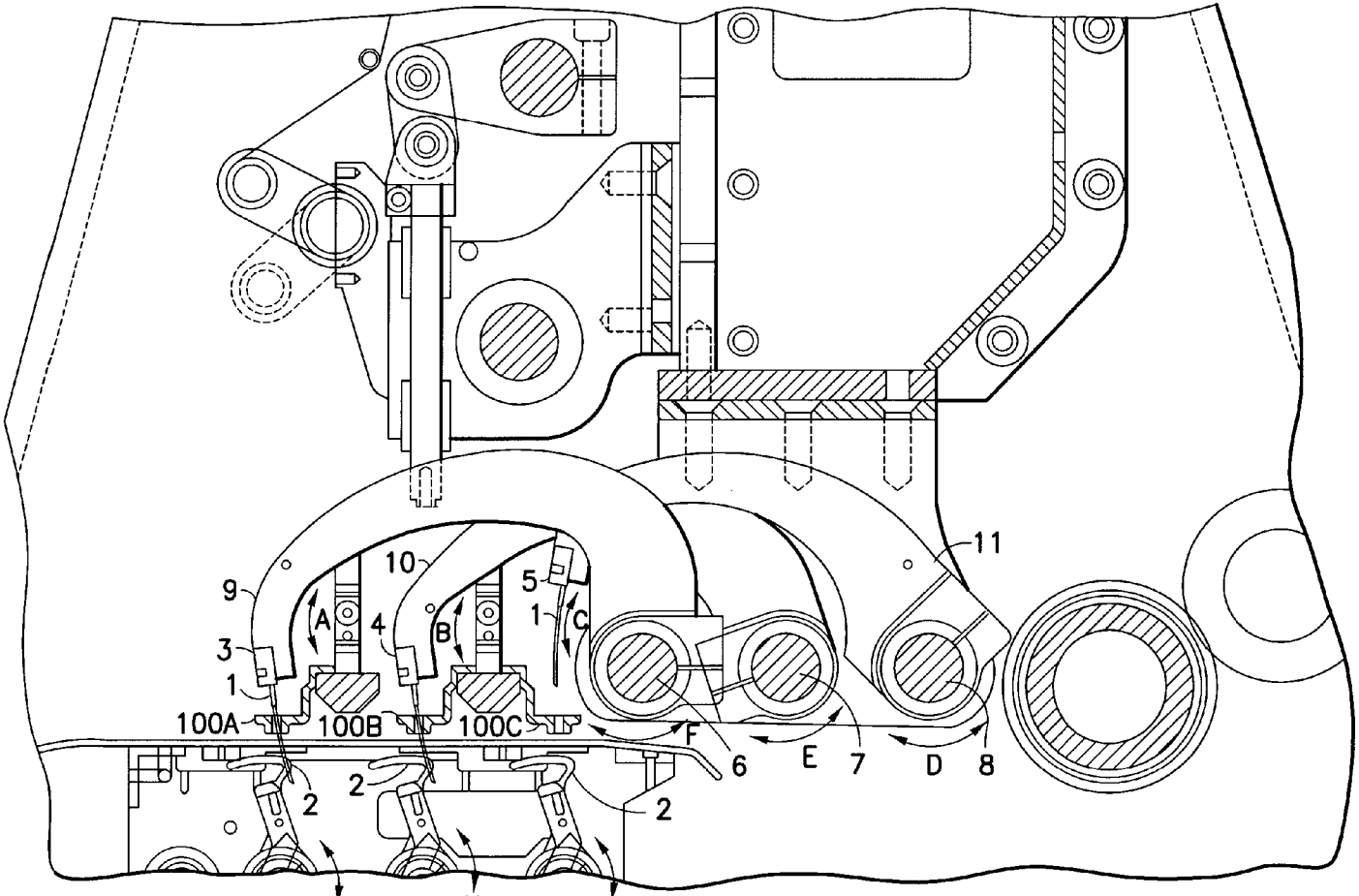
FIG. 1B shows various details associated with a portion of the machine as shown in FIG. 1A.

FIG. 1A shows a cross-sectional side view of a machine according to an embodiment of the present invention. Further, FIG. 1B shows various details associated with a portion of the machine as shown in FIG. 1A.

As seen in these FIGS. 1A and 1B, a free end of each of arms 9, 10, 11 is driven in this embodiment in a reciprocating manner in an arc (see arrows A,B,C of FIG. 1B which indicate the arcs along which the free ends of each of arms 9, 10, 11 is driven (the drive mechanism is discussed in more detail below). Of course, as the free ends of each of arms 9, 10, 11 is driven in an arc, each of needle bars 3,4,5 (which are attached, respectively, to arms 9, 10, 11) is also driven in an arc. Moreover, of course, as each of needle bars 3,4,5 is driven in an arc, each needle 1 is also driven in an arc (any desired number of needles may be attached to each needle bar).

In one example, one or more of the needles may be curved. In another example, all of the needles may be curved. In another example, at least one needle may have different radius of curvature than at least one other needle. In another example, all of the needles may have the same radius of curvature. In one specific example, a radius of curvature of a needle may be 200 mm.

Of note, in one embodiment, use of curved needles may provide for a lighter assembly that runs at a higher speed with a lower parts count.

Still referring to FIGS. 1A and 1B, it is seen that presser feet 100A, 100B100C may be reciprocated (e.g., by a motor) up and down by the components generally identified in FIG. 1A as Portion 100.

Still referring to FIGS. 1A and 1B, it is seen that hooks 2 may be reciprocated (e.g., by a motor) by the components generally identified in FIG. 1A as Portion 200 (see arrows G,H,I of FIGS. 1A and 1B showing the movement of hooks 2 around their respective pivot points).

Thus, as seen, each of needles 1 may be driven in an arc to cooperate with hooks 2 and presser feet 100A,100B,100C to perform any desired sewing, embroidering, quilting and/or the like.

Of course, the various components may be driven (e.g., reciprocated) by one or more motor(s). In one example, a first motor may drive (e.g., reciprocate) arms 9, 10, 11; a second motor may drive (e.g., reciprocate) presser feet 100A,100B, 100C; and a third motor may drive (e.g., reciprocate) hooks 2. In another example, a single motor may drive (e.g., reciprocate) arms 9, 10, 11 and/or presser feet 100A,100B,100C and/or hooks 2.

Still referring to FIGS. 1A and 1B, it is seen that arms 9, 10, 11 may be reciprocated up and down in their respective arcs (e.g., circular arcs) by rotating rods 6,7,8 (the drive mechanism for rotating rods 6,7,8 is discussed in more detail below). More particularly, rotating rods 6,7,8 (which may be reciprocally rotated as shown by arrows D, E, F of FIG. 1B) may drive arms 9, 10, 11 due to each of arms 9,10,11 being attached to one of rotating rods 6,7,8.

Figure 2A:
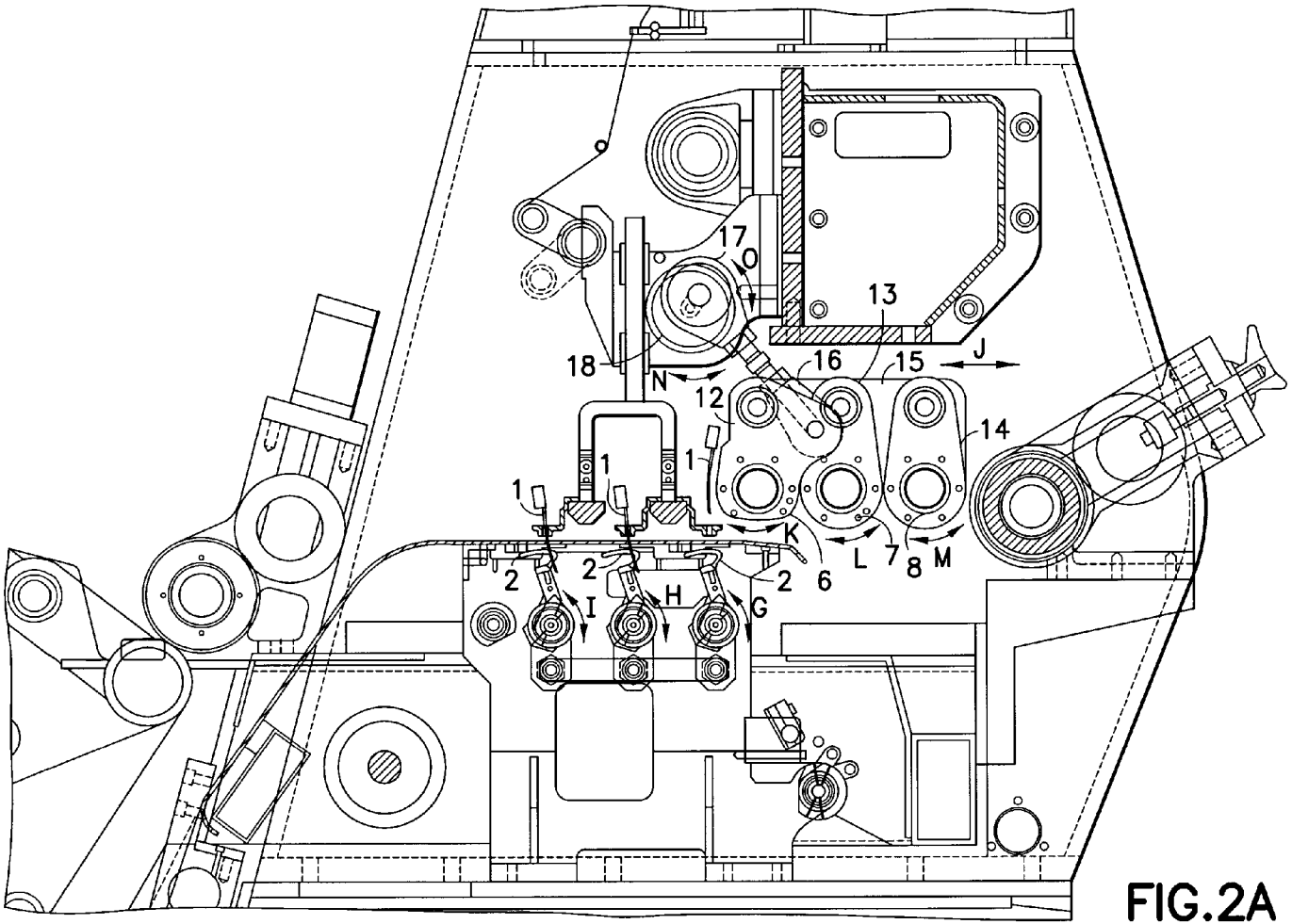
FIG. 2A shows a cross-sectional side view of the machine of FIG. 1A (this cross-sectional side view is taken at position different from the cross-sectional side view of FIG. 1A).
Figure 2B:
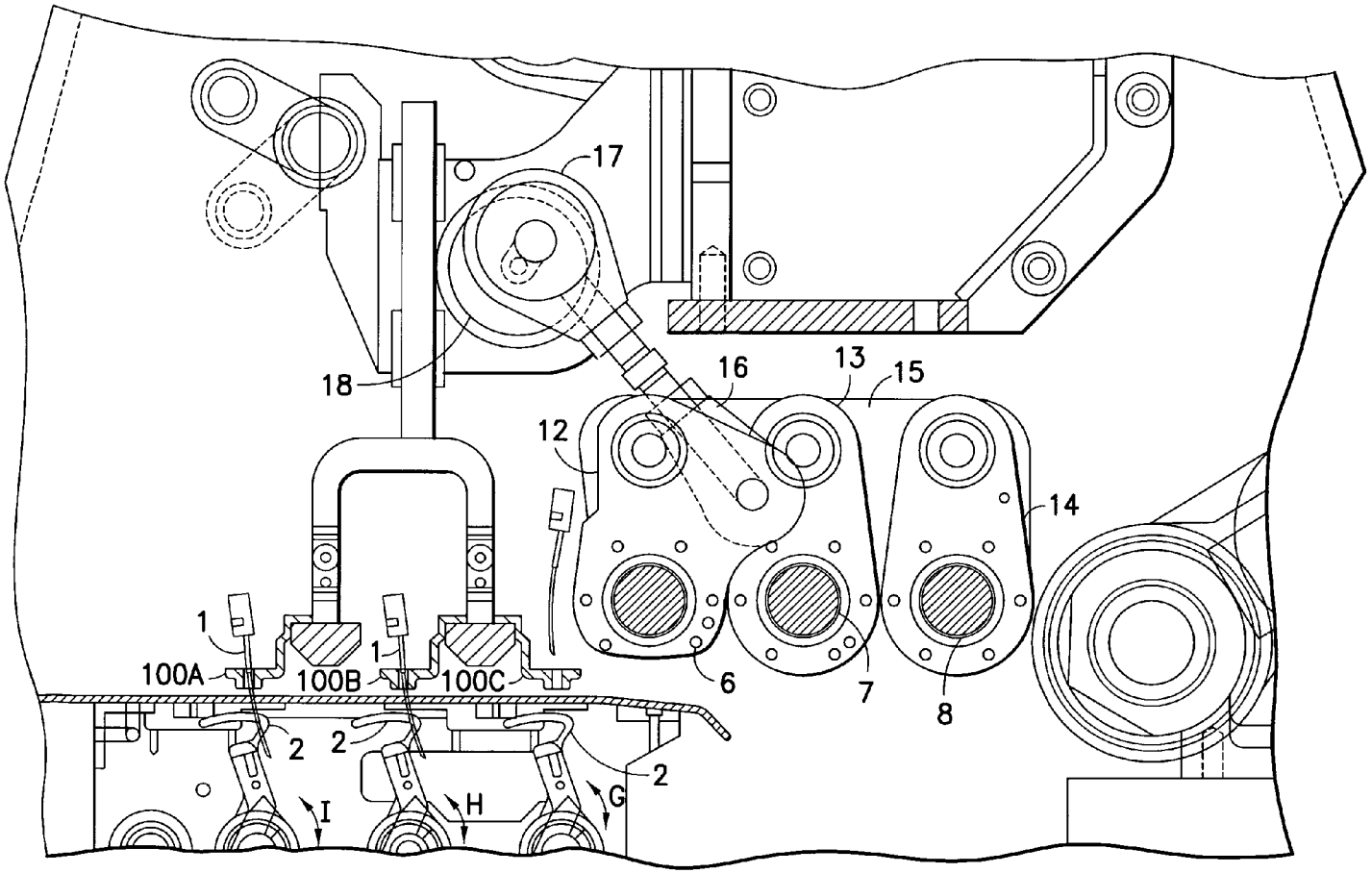
FIG. 2B shows various details associated with a portion of the machine as shown in FIG. 2A.
Figure 6:
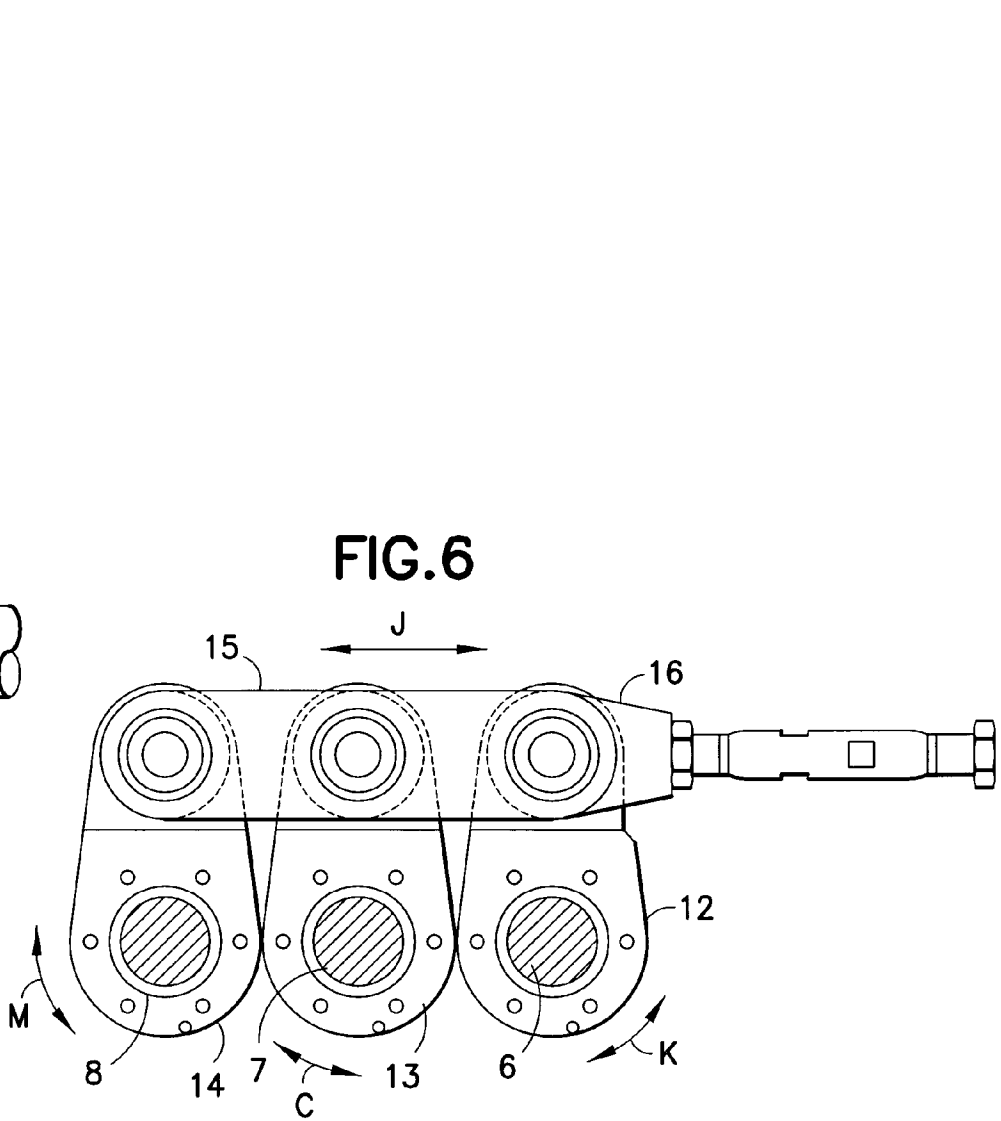
FIG. 6 shows various details associated with a portion of the machine as shown in FIGS. 2A and 2B.

Referring now to FIGS. 2A, 2B and 6, certain details regarding how rotating rods 6,7,8 are rotated back and forth as discussed above will be provided. More particularly, it is seen that each of rotating rods 6,7,8 has mounted thereto a respective connector element 12,13,14 (in one example, each of connector elements 12, 13,14 may comprise a clamp of the type discussed in more detail below). In addition, each of connector elements 12,13,14 is connected to tie bar 15 (such that the connector elements move together (see, e.g., FIGS. 2A and 6 where is seen that as tie bar 15 reciprocates along arrow J (in an essentially linear movement), each of rotating rods 6,7,8 is driven (by one of connector elements 12,13,14 when the respective clamp is engaged) to rotate back and forth (e.g., in a circular arc) as seen by arrows K,L,M).

Further, it is seen that tie bar 15 is driven to reciprocate along arrow J by the action of drive bar 16 (operatively connected at one end to connector element 12 and at the other end to eccentric 17). Of course, eccentric 17 converts the rotary motion shown by arrow N into the motion shown by arrow O associated with drive bar 16 (in one example, the rotation associated with eccentric 17 may be a back-and-forth rotation; in another example, the rotation associated with eccentric 17 may be a rotation in a single direction).

Again, various components may be driven by one or more motors (e.g., eccentric 17 may be driven by a motor to cause the various movements described above).

In one example, each of connector elements 12,13,14 may be clamped to each rotating rod 6,7,8 such that each clamp may be engaged (thus engaging the respective rotating rod 6,7,8, to cause the respective rotating rod 6,7,8 to reciprocate along with the respective connector element 12,13,14) or disengaged (thus disengaging the respective rotating rod 6,7,8 to allow the respective rotating rod 6,7,8 to not reciprocate along with the respective connector element 12,13,14). In another example, each clamp may be hydraulically and/or pneumatically activated (that is, engaged/disengaged). In another example, each clamp may be activated (that is, engaged/disengaged) under computer control.

In another example, each clamp may be activated (that is, engaged/disengaged) together (that is, all of the arms may be driven to reciprocate at one time). In another example, each clamp may be activated (that is, engaged/disengaged) independently (that is, one or more of the arms may be driven to reciprocate at one time while one or more other arms may not be driven to reciprocate at that time).

Figure 5:
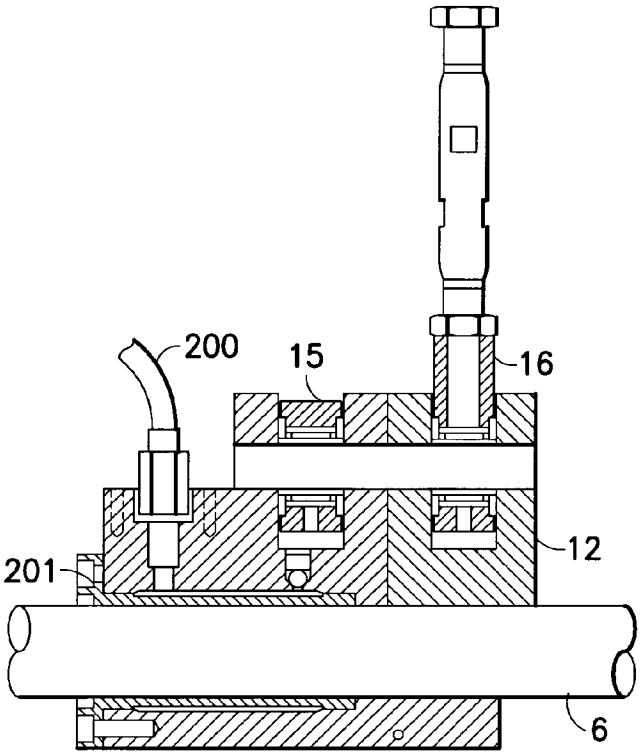
FIG. 5 shows various details associated with a portion of the machine as shown in FIG. 3.

Referring now to FIG. 5, certain additional details regarding a clamp of the type discussed above is shown (see, e.g., line 200 (which may carry hydraulic and/or pneumatic material (e.g., fluid, air, gas) and contact element 201 (comprising, for example, a clutch element or the like)).

Figure 3:
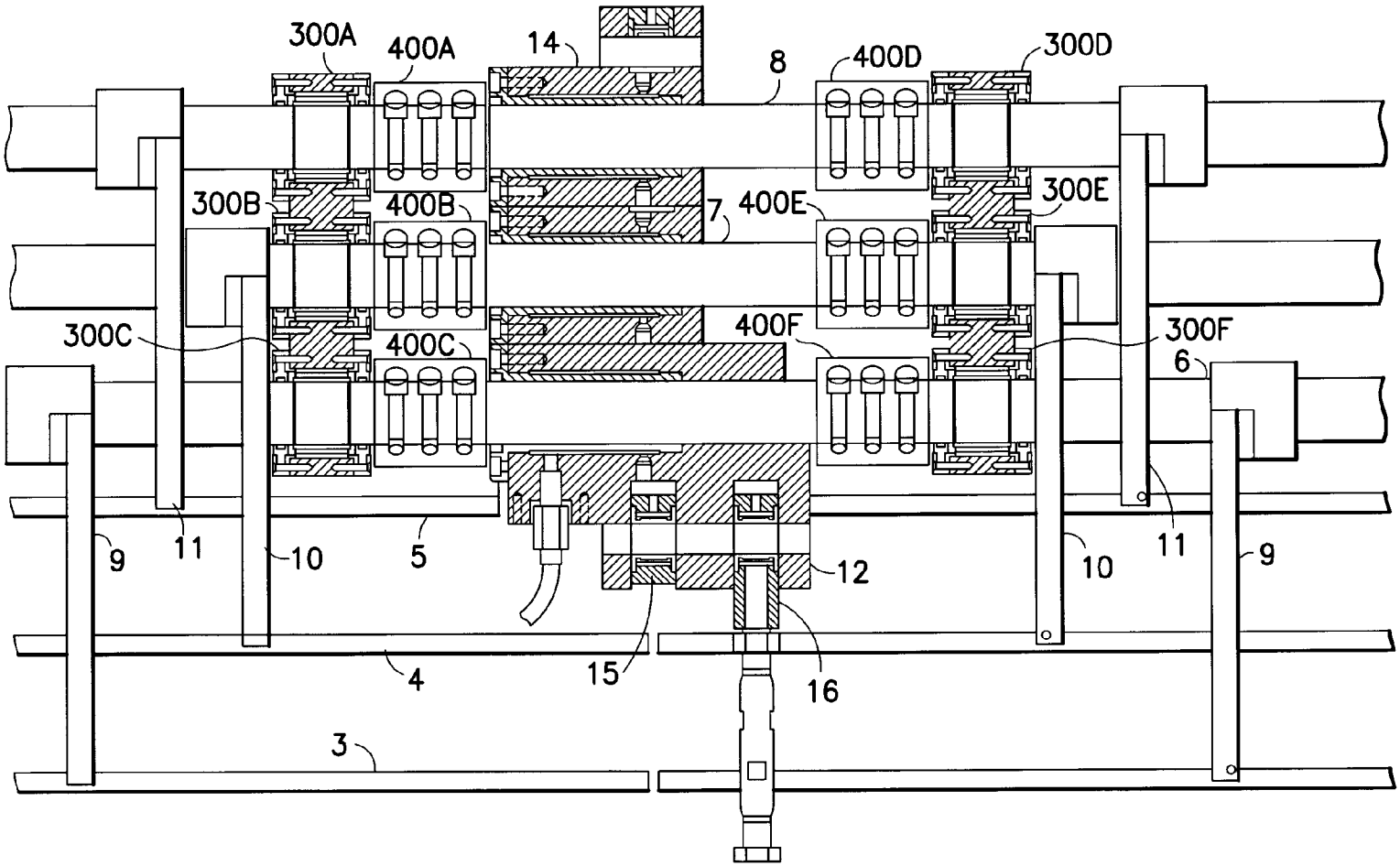
FIG. 3 shows a plan view of a portion of the machine of FIGS. 1A, 1B, 2A and 2C.

Referring now to FIG. 3, it is seen that various bearings may be utilized as desired (see, e.g., the example bearings 300A-300F of FIG. 3). Further, it is seen that, for example, connectors 400A-400F may be utilized to permit quick replacement of a component without removing an entire rotating rod (for example, connector element 12 may be removed and replaced by disconnecting elements 400C and 400F from rotating rod 6).

Figure 4:
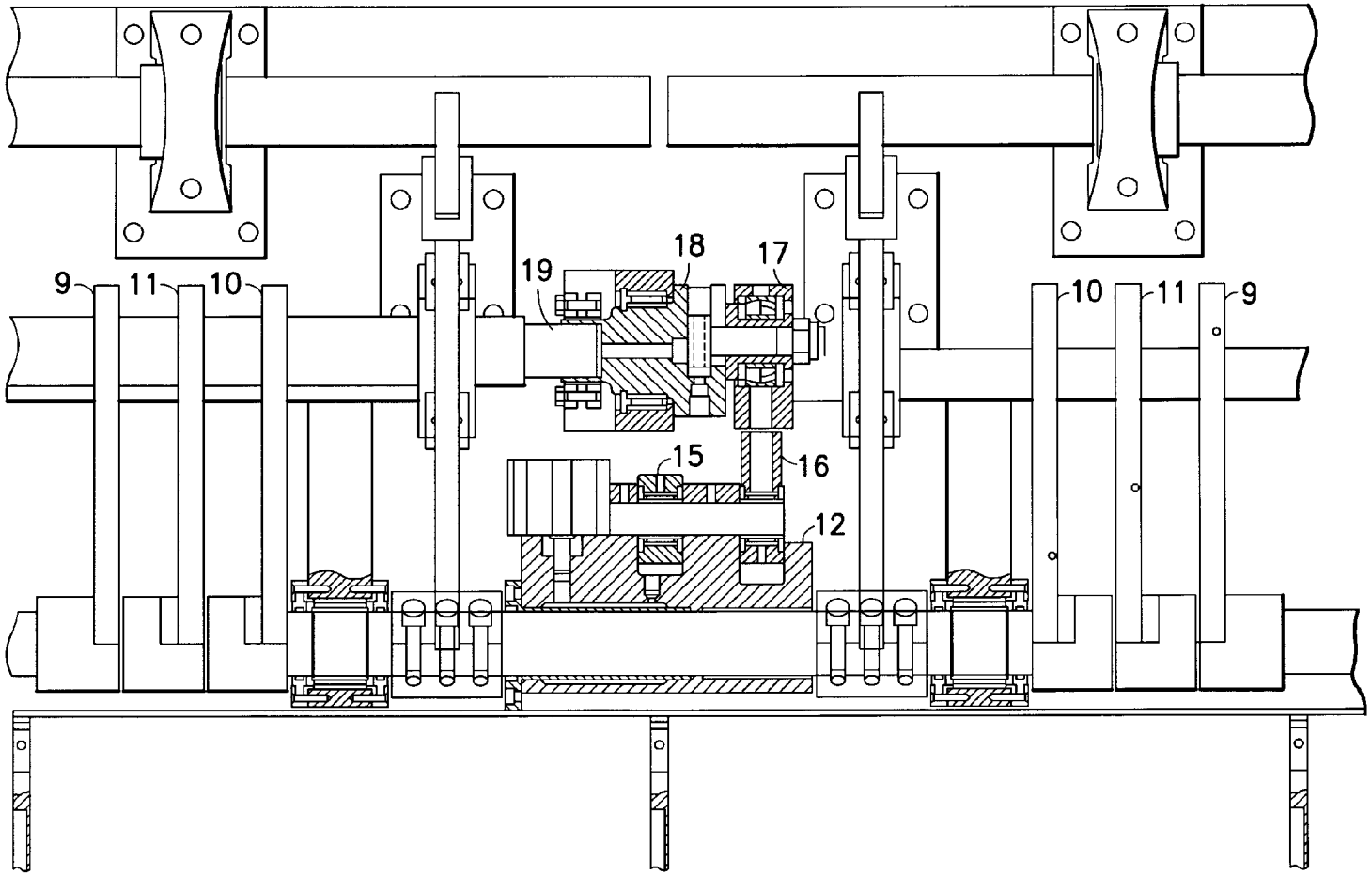
FIG. 4 shows a front view of a portion of the machine of FIGS. 1A, 1B, 2A and 2C.

Referring now to FIG. 4, this Fig. shows a front view of a portion of the machine of FIGS. 1A, 1B, 2A and 2B.

Figure 7A:
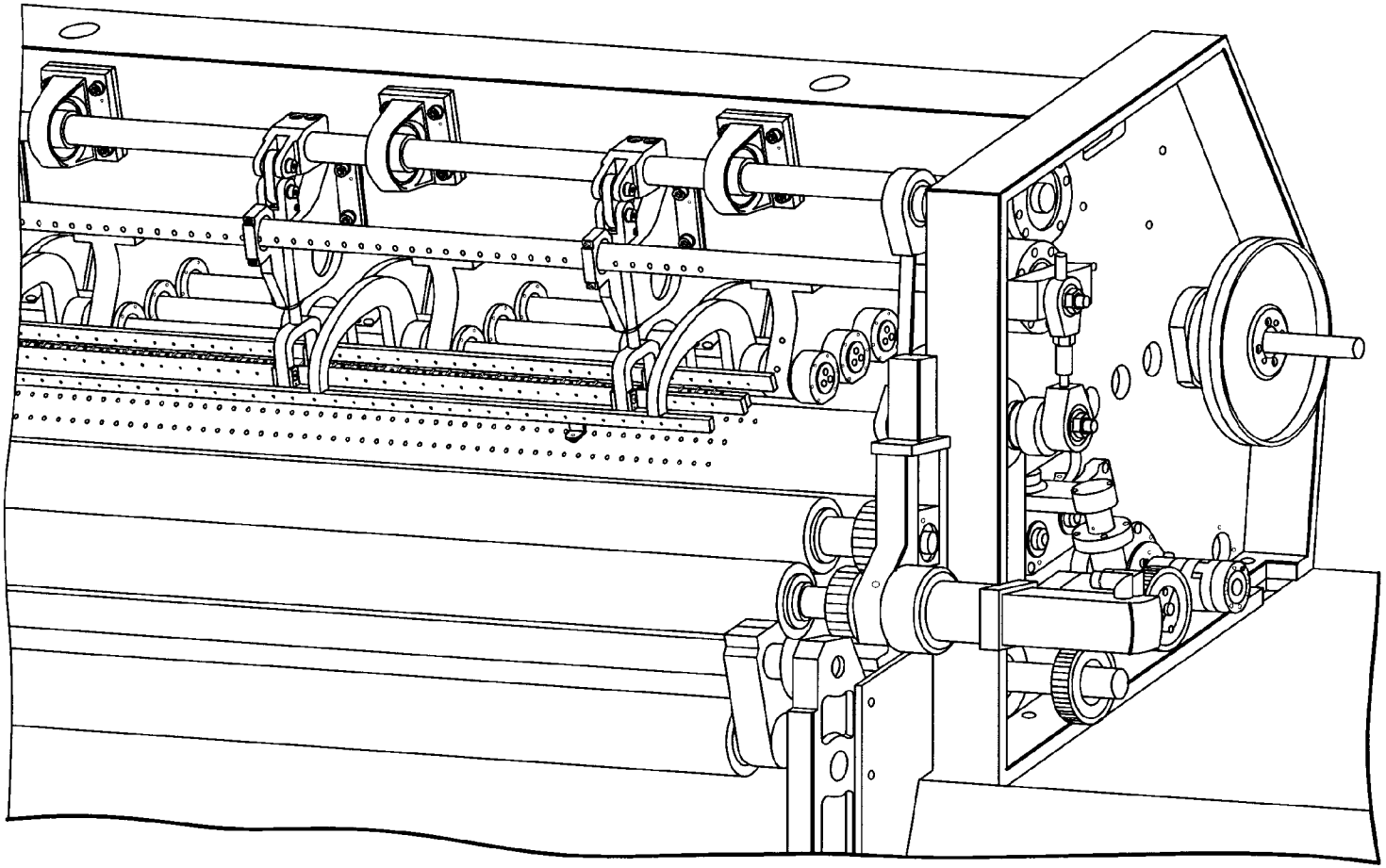
FIG. 7A shows a perspective view of a portion of the machine of FIGS. 1A, 1B, 2A and 2B.

Referring now to FIG. 7A, this Fig. shows a perspective view of a portion of the machine of FIGS. 1A, 1B, 2A and 2B.

Figure 7B:
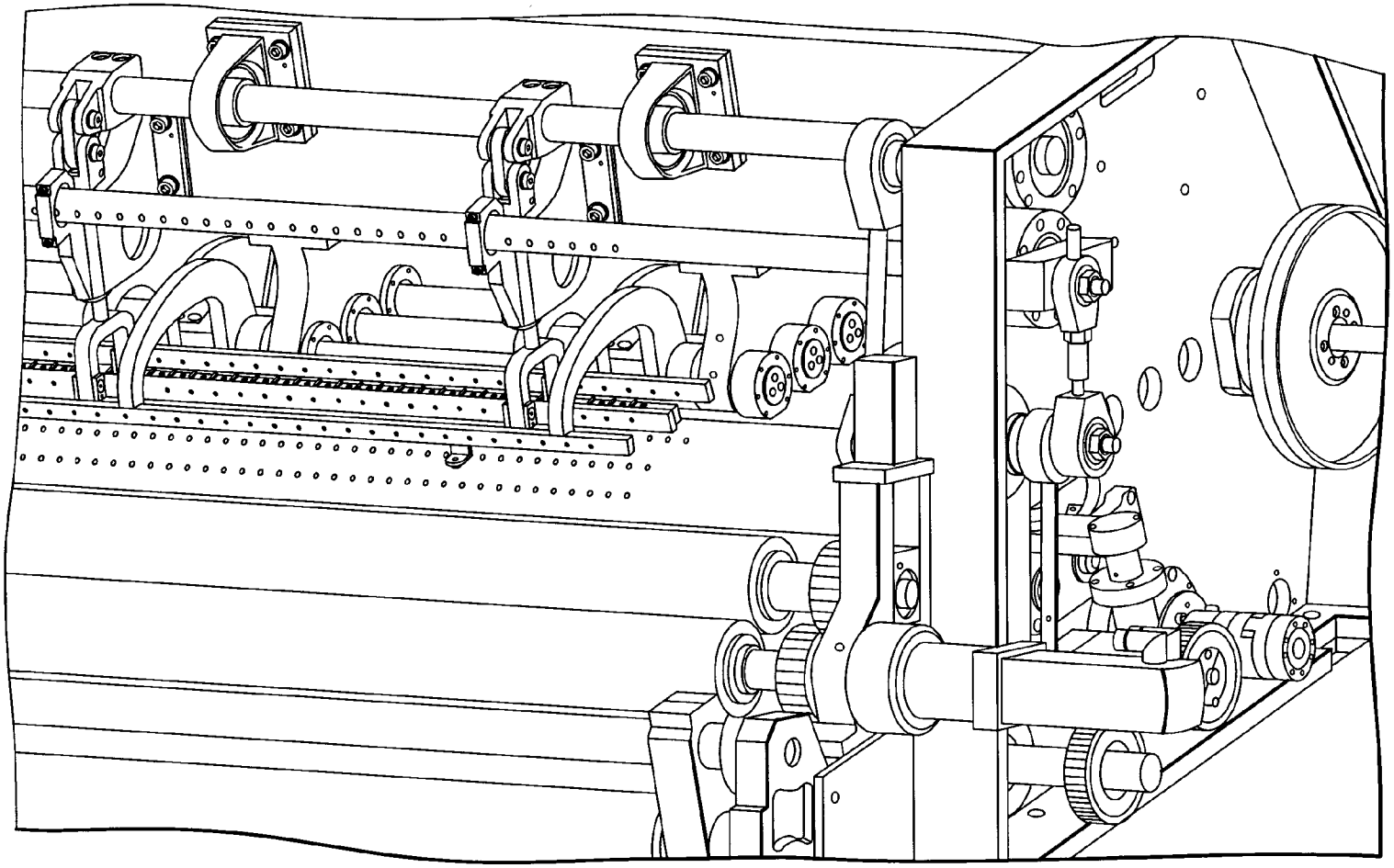
FIG. 7B shows various details associated with a portion of the machine as shown in FIG. 7A.

Referring now to FIG. 7B, this Fig. shows various details associated with a portion of the machine as shown in FIG. 7A.

Figure 8A:
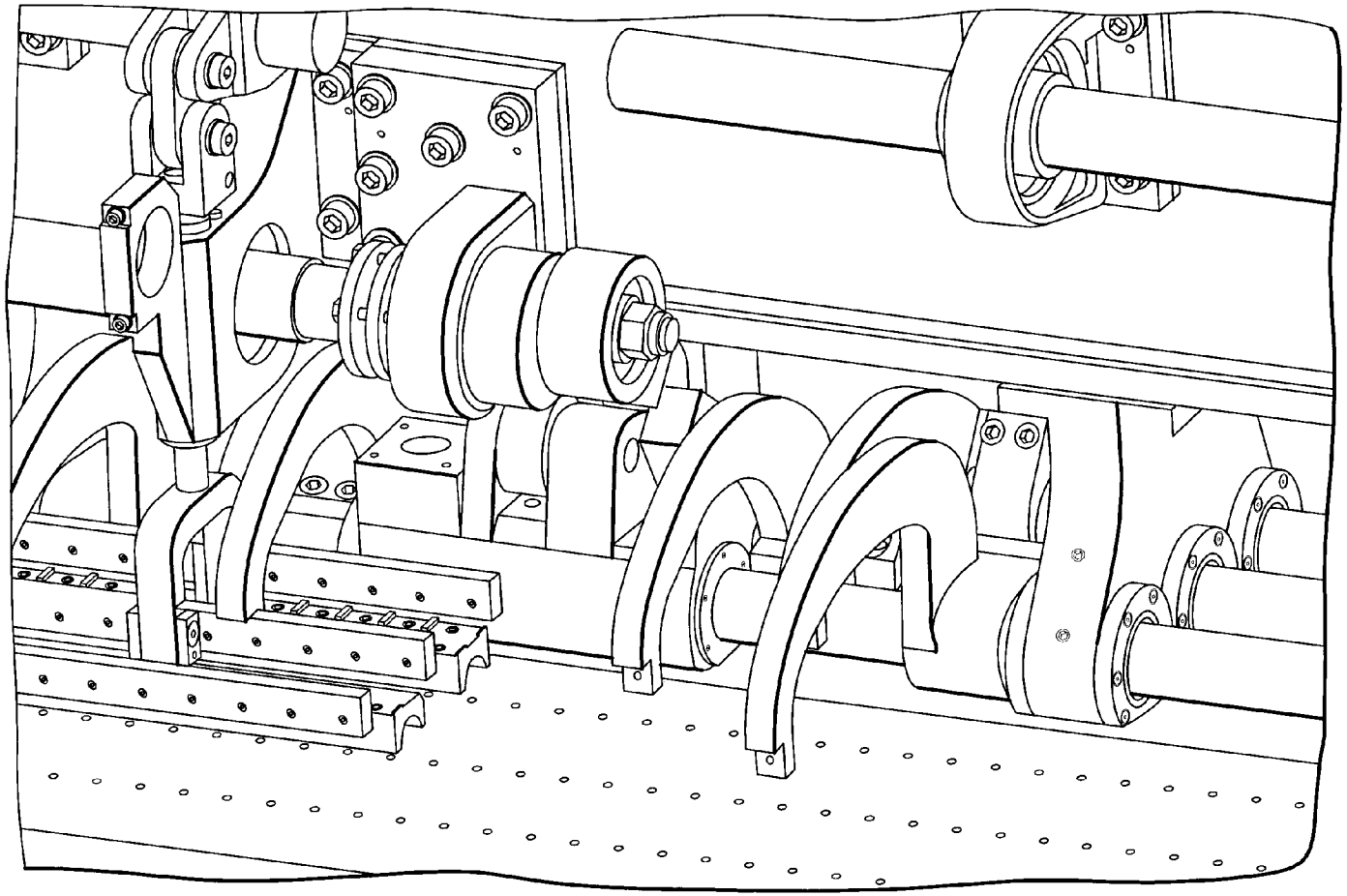
FIG. 8A shows another perspective view of a portion of the machine of FIGS. 1A, 1B, 2A and 2B.

Referring now to FIG. 8A, this Fig. shows another perspective view of a portion of the machine of FIGS. 1A, 1B, 2A and 2B.

Figure 8B:
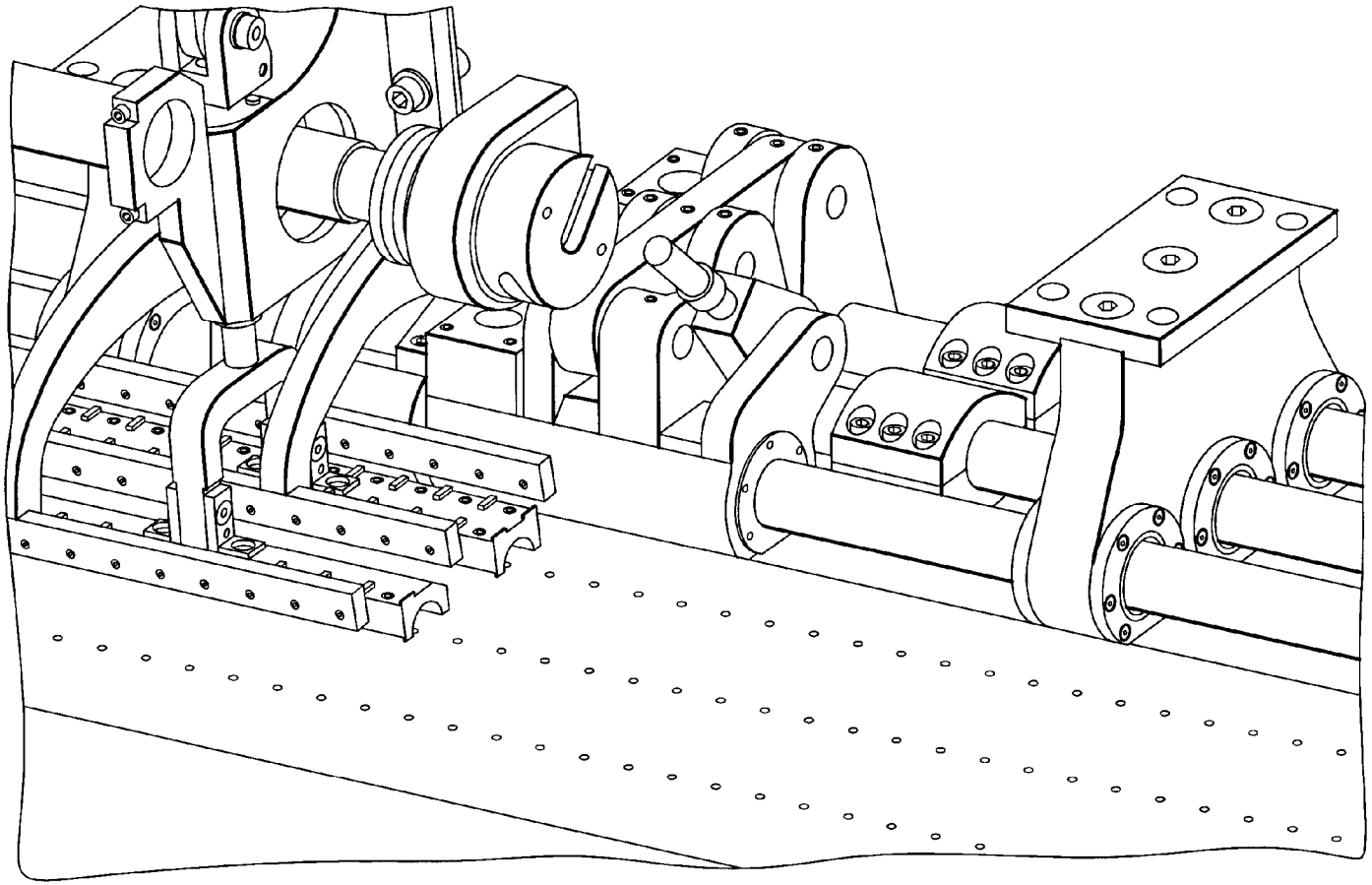
FIG. 8B shows another perspective view of a portion of the machine of FIGS. 1A, 1B, 2A and 2B (this view is similar to the view of FIG. 8A, but with certain parts removed to show other parts).

Referring now to FIG. 8B, this Fig. shows another perspective view of a portion of the machine of FIGS. 1A, 1B, 2A and 2B (this view is similar to the view of FIG. 8A, but with certain parts removed to show other parts).

Figure 9:
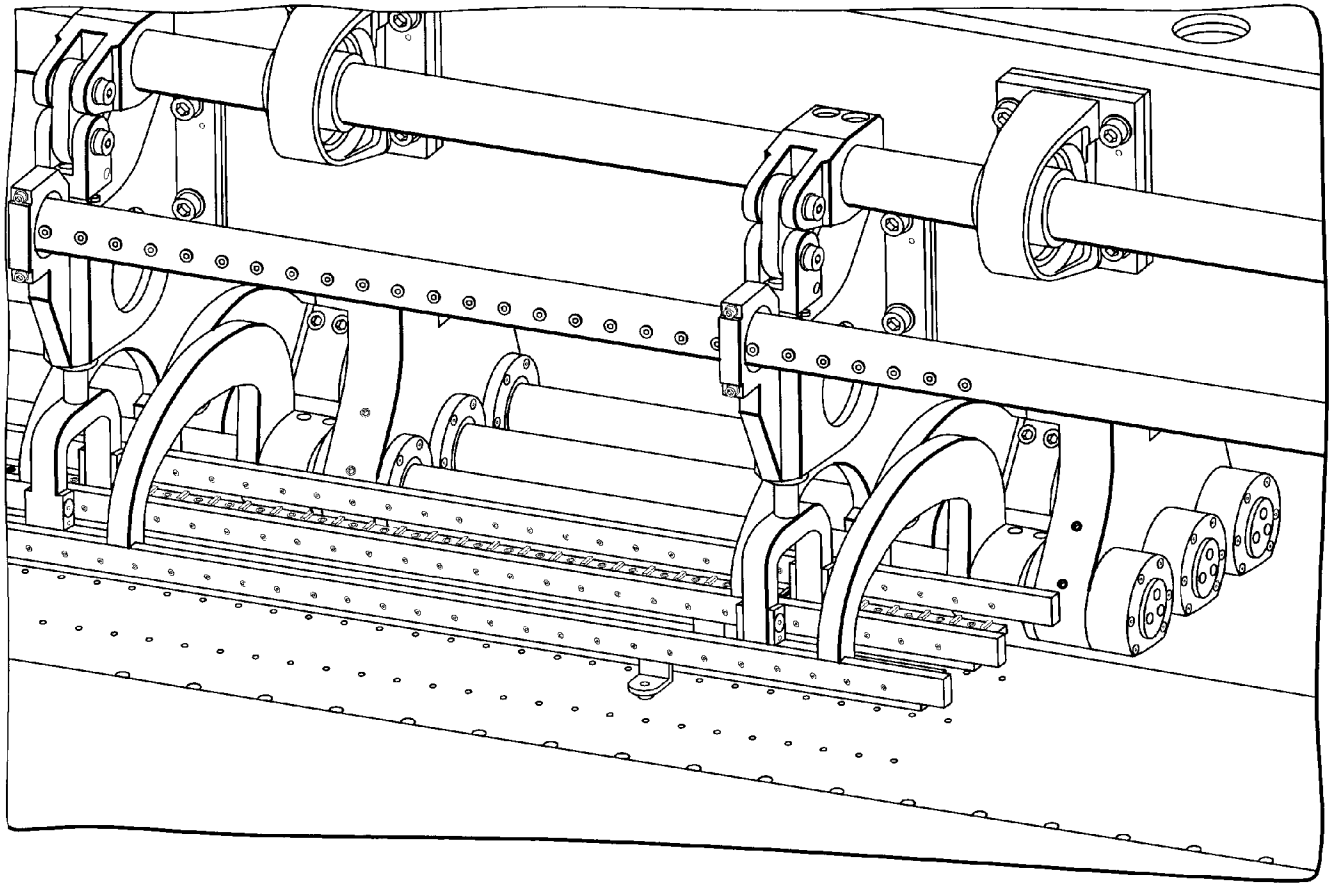
FIG. 9 shows another perspective view of a portion of the machine of FIGS. 1A, 1B, 2A and 2B.

Referring now to FIG. 9, this Fig. shows another perspective view of a portion of the machine of FIGS. 1A, 1B, 2A and 2B.

Figure 10:
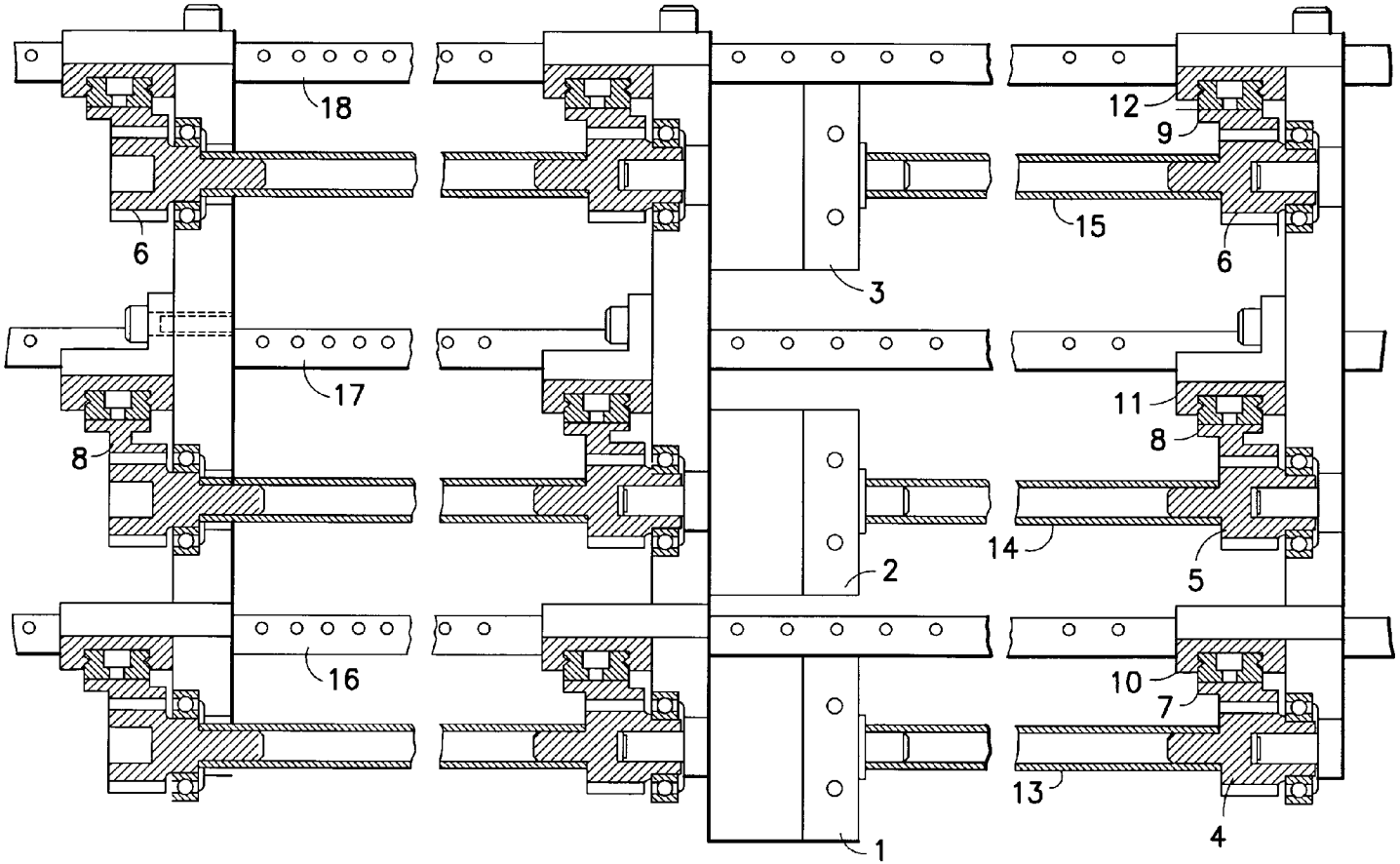
FIG. 10 shows a plan view of a portion of a machine with independent needle bars according to another embodiment of the present invention.

Referring now to FIG. 10, this Fig. shows a plan view of a portion of a machine with independent needle bars according to another embodiment of the present invention.

As described herein, various embodiments of the present invention may provide for the conversion of rotating motion (see, e.g., eccentric 17 and arrow N of FIG. 2A) to angular motion (see, e.g., arms 9,10,11 and arrows A,B,C of FIG. 1B).

In one example, all of the needle bars may be moved together (that is, at the same time in a manner such that movement of one needle bar is not independent from movement of the other needle bars). In another example, movement of one or more needle bars may be independent from movement of one or more other needle bars (this may be accomplished, for example, by engaging/disengaging one or more clamps as discussed herein). In another example, independently movable needle bars may be provided in a multiple needle bar machine (and/or method).

Of note, independently movable needle bars provided in a multiple needle bar machine (and/or method) may provide certain distinguishing feature(s) over an independent needle configuration. For example, an independent needle configuration may be very complicated (as compared, for example, to the above-mentioned independently movable needle bars configuration). In addition, an independent needle configuration may have problems with thread coming out of the needle when a given needle is raised above the work surface (this problem may be reduced or eliminated through use of the independently movable needle bars configuration described herein with reference to various embodiments of the present invention because a non-used needle bar may simply be left at rest). Further, in practice, independent needles may typically only be implementable on the first needle bar (due, for example, to the size of the implementing pistons and the limited space available in the vicinity of the needle bars (e.g., the limited space available between adjacent needle bars)).

In another embodiment, an independently movable needle bars configuration may be provided via a mechanism that permits one or more needle bars to be lifted up (such that the associated needles would not sew the work surface). In one example of this configuration, all of the needle bars may be moved together, but, as just mentioned, one or more of the needle bars may be raised as desired such that the needles associated with the raised needle bar(s) would not sew the work surface. Of course, the raised needle bar(s) could also be lowered when it was desired that the needles associated with such needle bar(s) would sew the work surface. In one specific example, needle bar(s) of this configuration could be raised/lowered using a rack and pinion gear system. In another example, each needle bar may be electrically, hydraulically and/or pneumatically raised/lowered. In another example, each needle bar may be raised/lowered under computer control. In another example, each needle bar may be raised/lowered together. In another example, each needle bar may be raised/lowered independently (that is, one or more of the needle bars may be raised at one time (such that the needles associated with the raised needle bar(s) would not sew the work surface) while one or more other needle bars may be left in the lowered position (such that the needles associated with the lower needle bar(s) would sew the work surface).

In another example, the machine may be a computer-implemented machine (e.g., implemented using one or more programmed processors).

In another example, the machine may operate at least in part in an automated manner.

In another example, the method may be a computer-implemented method (e.g., implemented using one or more programmed processors).

In another example, the method may be carried out at least in part in an automated manner.

In one example (which example is intended to be illustrative and not restrictive), a lock stitch may be carried out.

In another example (which example is intended to be illustrative and not restrictive), lock stitch cording may be carried out.

In another example (which example is intended to be illustrative and not restrictive), a moss stitch/chain chenille stitch may be carried out.

In another embodiment, a machine for making stitches with thread may be provided, comprising: at least one needle bar (see, e.g., needle bars 3, 4, 5 in FIGS. 1A and 1B), wherein the needle bar has attached thereto a plurality of needles (see, e.g., needles 1 in FIGS. 1A, 1B, 2A and 2B); a drive train (see, e.g., elements 17, 16, 15, 14, 13, 12, 8, 7 and 6 in FIG. 2B—of note, as described above, one or more motors (e.g., electric motors) may drive element 17); and at least one arm (see, e.g., arms 9, 10 and 11 in FIGS. 1A and 1B), the arm having a first end and a second end, the first end of the arm being connected to the drive train and the second end of the arm having attached thereto the needle bar; wherein the arm is moved by the drive train such that the second end of the arm moves along a path forming an arc; and wherein each of the plurality of needles is elongated along a long axis and wherein each of the plurality of needles is curved along the long axis.

In one example, the machine may perform one (or more) of: (a) sewing; (b) embroidering; and/or (c) quilting.

In another example, the machine may stitch a double-needle chain stitch.

In another example, the arc may be a semi-circular arc.

In another example, each of the arm(s) may be moved by the drive train such that the second end of each arm reciprocates back and forth along the path forming the arc.

In another example, at least a plurality of the needles may have the same radius of curvature along the long axis of each of the needles.

In another example, all of the needles may have the same radius of curvature along the long axis of each of the needles.

In another example, the radius of curvature of at least a first one of the plurality of the needles may be different along the long axis of the first one of the plurality of needles than the radius of curvature of at least a second one of the plurality of the needles along the long axis of the second one of the plurality of needles.

In another example, the machine may further comprise a programmed computer.

In another example, the drive train may comprise at least one motor.

In another example, the motor may comprise an electric motor.

In another embodiment, a machine for making stitches with thread is provided, comprising: a first needle bar (see, e.g., needle bars 3, 4, 5 in FIGS. 1A and 1B) having attached thereto a plurality of needles (see, e.g., needles 1 in FIGS. 1A, 1B, 2A and 2B); a second needle bar (see, e.g., needle bars 3, 4, 5 in FIGS. 1A and 1B) having attached thereto a plurality of needles (see, e.g., needles 1 in FIGS. 1A, 1B, 2A and 2B); a drive train (see, e.g., elements 17, 16, 15, 14, 13, 12, 8, 7 and 6 in FIG. 2B—of note, as described above, one or more motors (e.g., electric motors) may drive element 17); a first arm (see, e.g., arms 9, 10 and 11 in FIGS. 1A and 1B), the first arm having a first and a second end, the first end of the first arm being selectively driven by the drive train and the second end of the first arm having attached thereto the first needle bar; and a second arm (see, e.g., arms 9, 10 and 11 in FIGS. 1A and 1B), the second arm having a first and a second end, the first end of the second arm being selectively driven by the drive train and the second end of the second arm having attached thereto the second needle bar; wherein, when the first end of the first arm is driven by the drive train, the first arm is moved by the drive train such that the second end of the first arm moves along a path forming a first arc; wherein, when the first end of the second arm is driven by the drive train, the second arm is moved by the drive train such that the second end of the second arm moves along a path forming a second arc; and wherein the driving of the first end of the first arm by the drive train is independent of the driving of the first end of the second arm by the drive train.

In one example, the machine may perform one (or more) of: (a) sewing; (b) embroidering; and/or (c) quilting.

In another example, the machine may stitch a double-needle chain stitch.

In another example: the drive train may comprise a first connector element (see, e.g., connector elements 12, 13, 14 in FIGS. 2A and 2B), a second connector element (see, e.g., connector elements 12, 13, 14 in FIGS. 2A and 2B), a first rod (see, e.g., rods 6, 7, 8 in FIGS. 2A and 2B) and a second rod (see, e.g., rods 6, 7, 8 in FIGS. 2A and 2B); wherein the first end of the first arm may be fixed to the first rod and the first rod may be selectively rotated by engagement with the first connector element; and wherein the first end of the second arm may be fixed to the second rod and the second rod may be selectively rotated by engagement with the second connector element.

In another example: the first end of the first arm may be fixed to the first rod and the first rod may be selectively reciprocally rotated back and forth by engagement with the first connector element; and the first end of the second arm may be fixed to the second rod and the second rod may be selectively reciprocally rotated back and forth by engagement with the second connector element.

In another example, the first connector element may comprise a first clamp and the second connector element may comprise a second clamp.

In another example, each of the first clamp and the second clamp may comprise at least one of: (a) an electromagnet clamping element; (b) a hydraulic clamping element; and/or (c) a pneumatic clamping element.

In another example, the drive train may comprise at least one motor.

In another example, the motor may comprise an electric motor.

In another example, the drive train may comprise at least one motor operatively connected to reciprocally rotate the first connector element back and forth and to reciprocally rotate the second connector element back and forth.

In another example: the first arm may be moved by the drive train such that the second end of the first arm reciprocates back and forth along the path forming the first arc; and the second arm may be moved by the drive train such that the second end of the second arm reciprocates back and forth along the path forming the second arc.

In another example: when the first end of the first arm is not driven by the drive train the first arm may be essentially stationary; and when the first end of the second arm is not driven by the drive train the second arm may be essentially stationary.

In another example, the first arc and the second arc may have the same radius of curvature.

In another example, a radius of curvature of the first arc may be different from a radius of curvature of the second arc.

In another example: the first arc may be a semi-circular arc; and the second arc may be a semi-circular arc.

In another example, each of the plurality of needles may be elongated along a long axis and each of the plurality of needles may be curved along the long axis.

In another example, at least a plurality of the needles may have the same radius of curvature along the long axis of each of the needles.

In another example, all of the needles may have the same radius of curvature along the long axis of each of the needles.

In another example, a radius of curvature of at least a first one of the plurality of the needles may be different along the long axis of the first one of the plurality of needles than a radius of curvature of at least a second one of the plurality of the needles along the long axis of the second one of the plurality of needles.

In another example, the machine may further comprise a programmed computer.

In another example, the machine may further comprise a programmed computer, wherein the programmed computer may be operatively connected to the first clamp and the second clamp to provide independent control over the movement of the first arm and the second arm.

In another embodiment, a machine for making stitches with thread is provided, comprising: x number of needle bars (see, e.g., needle bars 3, 4, 5 in FIGS. 1A and 1B), each of the needle bars having attached thereto a plurality of needles (see, e.g., needles 1 in FIGS. 1A, 1B, 2A and 2B); a drive train (see, e.g., elements 17, 16, 15, 14, 13, 12, 8, 7 and 6 in FIG. 2B—of note, as described above, one or more motors (e.g., electric motors) may drive element 17); y number of arms (see, e.g., arms 9, 10 and 11 in FIGS. 1A and 1B), each of the arms having a first and a second end, the first end of each of the arms being selectively driven by the drive train and the second end of each of the arms having attached thereto one of the needle bars; wherein, when the first end of each of the arms is driven by the drive train, each of the arms is moved by the drive train such that the second end of each of the arms moves along a path forming an arc; wherein the driving of the first end of at least one of the arms by the drive train is independent of the driving of the first end of each of the other arms by the drive train; wherein x is an integer between 2 and 20; and wherein y is an integer between 2 and 20.

In one example, the driving of the first end of each of the arms by the drive train may be independent of the driving of the first end of each of the other arms by the drive train.

Figure 11:
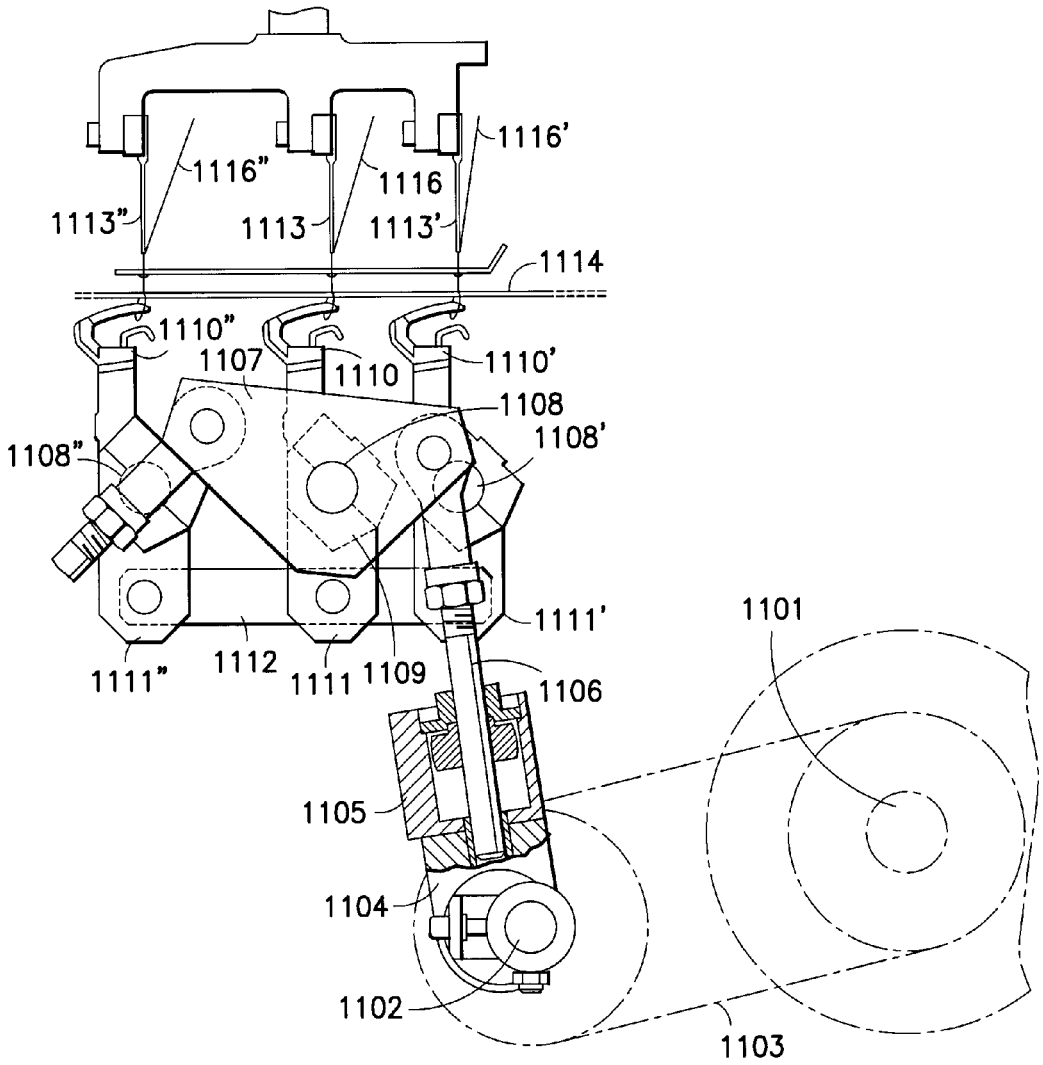
FIGS. 11-13 show various views of a portion of a machine according to another embodiment of the present invention
Figure 12:
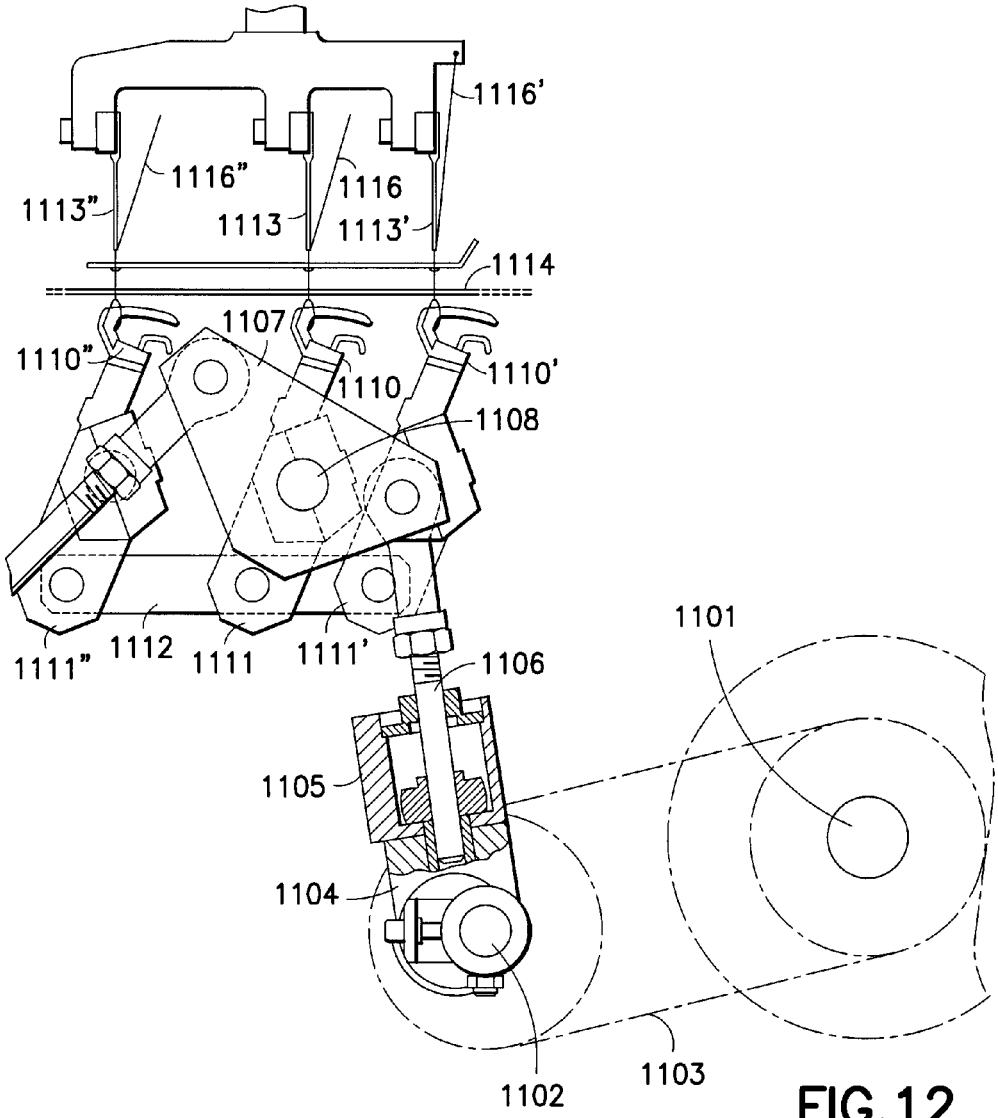
Figure 13:
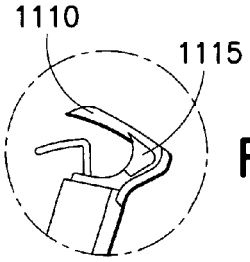

Referring now to FIGS. 11-13, another embodiment of the present invention related to an electronically controlled multi-needle quilting machine is shown (in one example, the machine may include a linking cylinder arranged between an eccentric integral with a rotating spindle and a lever to drive in an oscillating motion a number of loopers which, in combination with a number of corresponding needles, perform stitching operations by double chain stitches on a layered material interposed between said members, said linking cylinder comprising, e.g., a pneumatic cylinder controlled to change the extension of its rod during the various operational steps, whereby the link length is changed and the loopers may reach a position in which, by being provided with a blade they perform a cutting operation on thread of a respective needle).

In another example, the invention may provide a multi-needle quilting machine adapted to produce an array of closed pattern designs which are completely isolated from each other already at the end of an automatic manufacturing operation.

In another example, an electronically controlled multi-needle quilting machine may be provided (e.g., including link means arranged between an eccentric mounted on a rotating spindle and a lever to drive, in an oscillatory motion, a plurality of loopers which, in combination with a plurality of corresponding needles, perform a double chain stitching on a layered material interposed between said members, wherein said link means may comprise a pneumatic cylinder controlled in such a way that the piston rod thereof projects outside in a variable extent during the various manufacturing steps whereby the length of the link is changed and the loopers reach a position in which, being provided with a blade, they cut the thread of a respective needle).

Referring now to FIG. 11, the quilting machine according to this embodiment is shown to include a main spindle 1101 which drives a secondary spindle 1102 parallel thereto, by means of a belt 1103 mounted on suitable pulleys. On spindle 1102 there is mounted an eccentric 1104 integral with a pneumatic cylinder 1105 whose rod 1106 is connected to an end of a substantially triangularly shaped lever 1107. Said lever is pivoted on a shaft 1108 carrying fastened thereon supports of a first row of loopers 1110 parallel to each other, only the first of which loopers of this row is visible in this figure. A second and a third row, for example, of loopers 1110', 1110" are located on the front and rear side of said first row and pivoted around shafts 1108', 1108" parallel to said first shaft 1108, while at the ends of said shafts there are fastened respective levers 1111, 1111', 1111", hingedly connected by a transverse bar 1112. Of note, there may be any desired number of looper(s) in each row and any desired number of row(s) of looper(s).

Above the three rows of loopers of this example, suitable dragging rollers (not shown) cause a sliding motion of the layered material 1114 (which in the following, for sake of simplicity, is called fabric) which is operated upon by means of three rows of needles 1113, 1113' and 1113", each of which is positioned at a respective looper 1110, 1110', 1110". During the stitching step shown in FIG. 11, rod 1106 of pneumatic cylinder 1105 is kept in a position of maximum extension, while said cylinder is actuated in a substantially reciprocating motion by means of eccentric 1104 mounted on spindle 1102. Therefore, cylinder 1105 behaves like a link.

According to what has been said above, lever 1107 is driven in an oscillating motion and it subjects to an alternating rotary motion both shaft 1108 integral therewith and shafts 1108' and 1108" through bar 1112 and levers 1111, 1111' and 1111".

Therefore, in this example, all the loopers of the machine are subjected to an oscillating motion and, in combination with the motion of the corresponding needles, they perform the double chain stitching used for quilting fabric 1114. It should be noted that each double chain stitch is made by two threads only one of which, shown at 1116, 1116', 1116" passes through a respective needle 1113, 1113', 1113". It should further be noted that in this step of this example each looper cooperates to working on the fabric with its upper portion only.

When a machine operating cycle is over, i.e., when each needle has finished its stitching, the quilting machine control unit stops needles 1113, 1113', 1113" in a raised position relative to fabric 1114, and with respective threads 1116, 1116', 1116" loaded on corresponding loopers 1110, 1110', 1110", while also main spindle is stopped. Said threads, that during the stitching operations were substantially braked, are left free, and fabric 1114 is moved forward through a span whose length may be programmed in order to control the length of the portion of thread inserted through the needle, with which the operation will have to be resumed next.

At this point, after threads 1116, 1116', 1116" have been locked again, pneumatic cylinder 1105 is biased in such a way as to bring rod 6 thereof in the minimum extension position, whereby the lever is rotated and, according to what has been said above, the same thing takes place for loopers 1110, 1110', 1110". In particular, the central row of loopers driven directly by lever 1107, transmits an identical motion to the front and back row of loopers through bar 1112 and levers 1111, 1111', 1111", whereby all the loopers result to be located in the position shown in the drawing (see, e.g., FIG. 12), corresponding to a substantially larger rotation compared to the one performed during a regular oscillating motion during the stitching step.

The figure (e.g., FIG. 12) shows that, following the above described motion, each thread 1116, 1116', 1116" slides all the way to the neck of a respective looper 1110, 1110', 1110" and it is in this point that the thread gets cut.

In fact, FIG. 13 shows that, at the neck of each looper 1110 there is mounted a blade 1115 for cutting the thread and, once said operation has been performed, the machine is brought back to the FIG. 11 condition, and the normal stitching cycle is resumed.

It should be noted that, when using a quilting machine according to this embodiment, in addition to doing completely away with the manual thread cutting step, it is possible to program the automatic cutting of said thread in such a way that the final look is improved. In fact, by dragging fabric 1114 along a suitable span in the step ahead of thread cutting, "thread tails" are obtained (i.e., lengths of thread going from the cutting point to the needles eye) long enough to make it possible to resume normally the stitching operation after the cutting operation, but short enough to prevent the cut end of the thread to be left outside the surface of the fabric once the stitching has been resumed. It should eventually be noted that the machine in various embodiments can go through the sequence of operations necessary for the thread cutting cycle within few a seconds, therefore without any substantial influence on the production times.

It is understood that pneumatic cylinder 1105 may be replaced by any desired device, suitable for moving rod 1106 according to the ways described herein above, while loopers 1110, blades 15 mounted thereon, and all the mechanical components mentioned above may be of any other type suitable for their purpose.

Reference will now be made to FIGS. 14A-14F, showing various phases (movement phases) of a looper (or hook) used in connection with applying, e.g., double chain stitch sewing (in one example, the phases move from FIG. 14A to 14B to 14C to 14D to 14E to 14F and back to 14A (e.g., in a repeating cycle). As seen, these figs include needle 1401, looper (or hook) 1403, spreader 1406, upper thread 1402, lower thread 1404, work surface 1410 and material 1412 (similar elements are also shown in FIGS. 15-19).

Figure 14A:
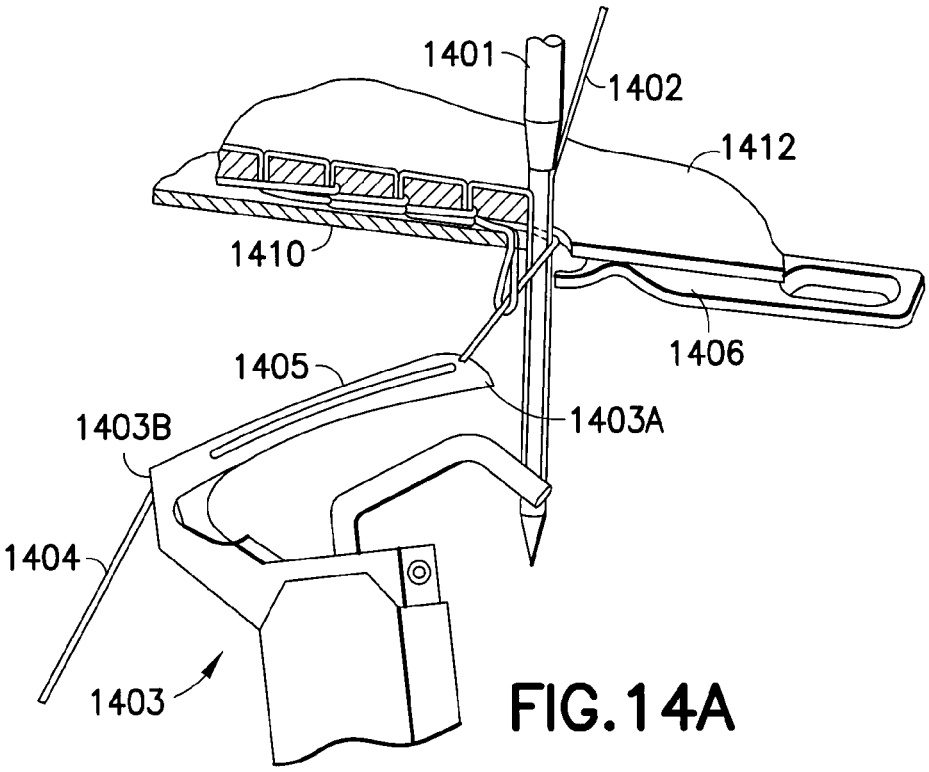
FIGS. 14A-14F show various views of a looper (or hook) at various phases of movement according to an embodiment of the present invention (in one example, the looper (or hook), as well as the various phases, shown in these FIGS. 14A-14F may be utilized in connection with the machine shown in FIGS. 11-13).
Figure 14B:
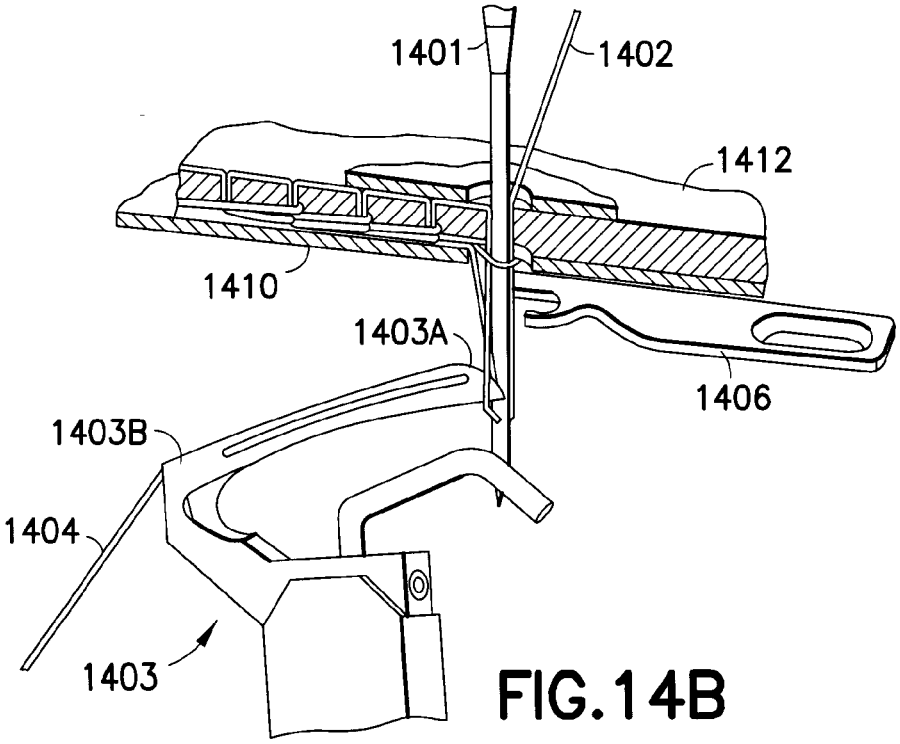
Figure 14C:
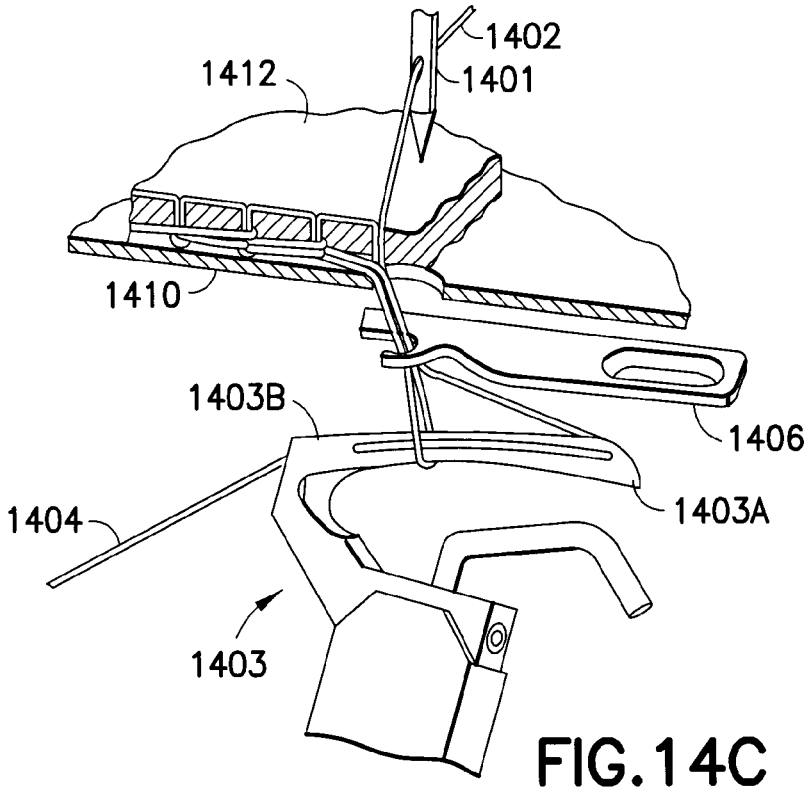
Figure 14D:
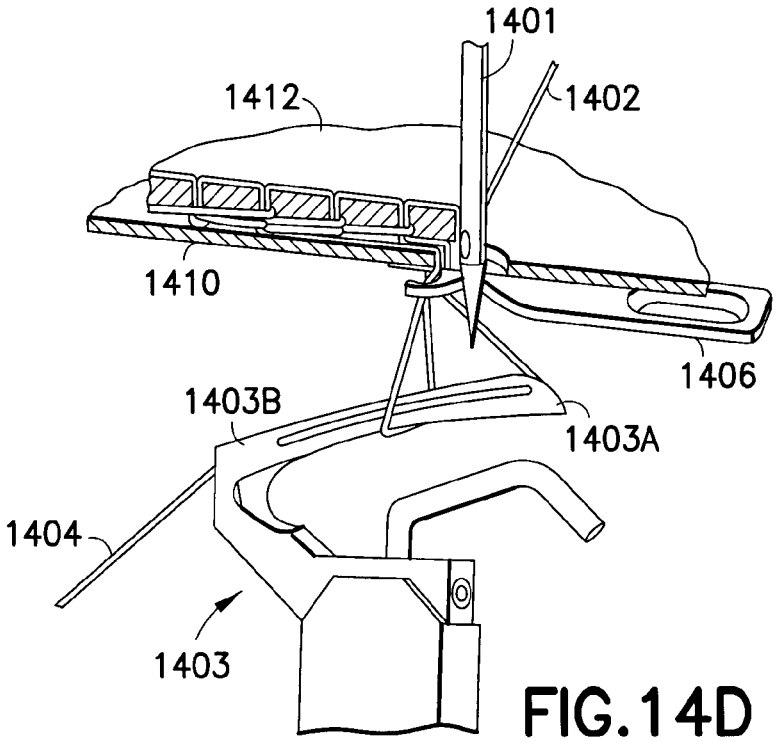
Figure 14E:
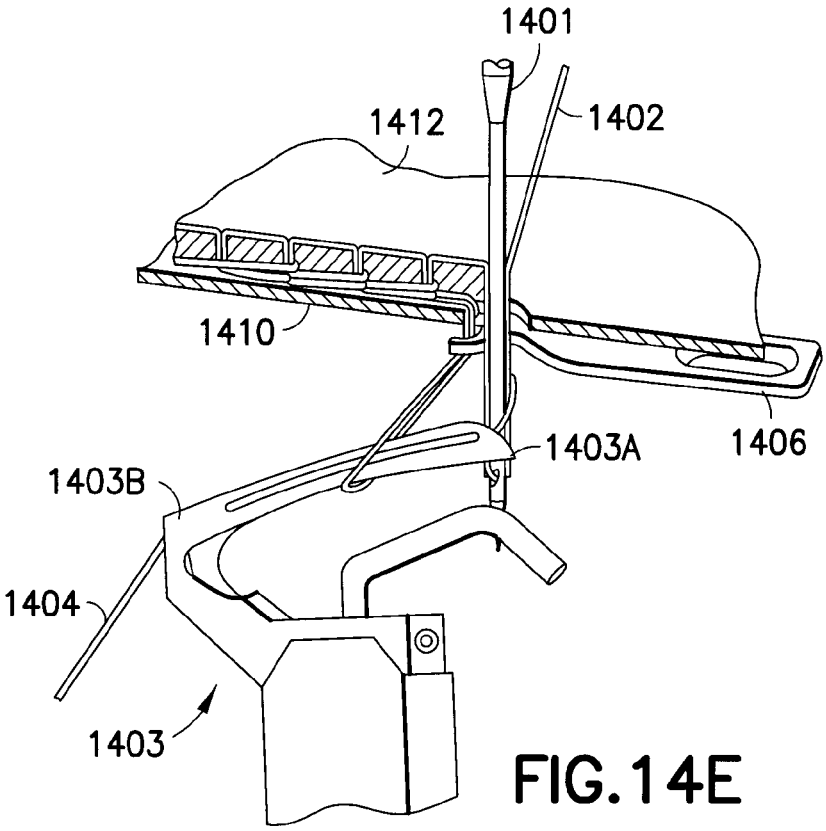
Figure 14F:
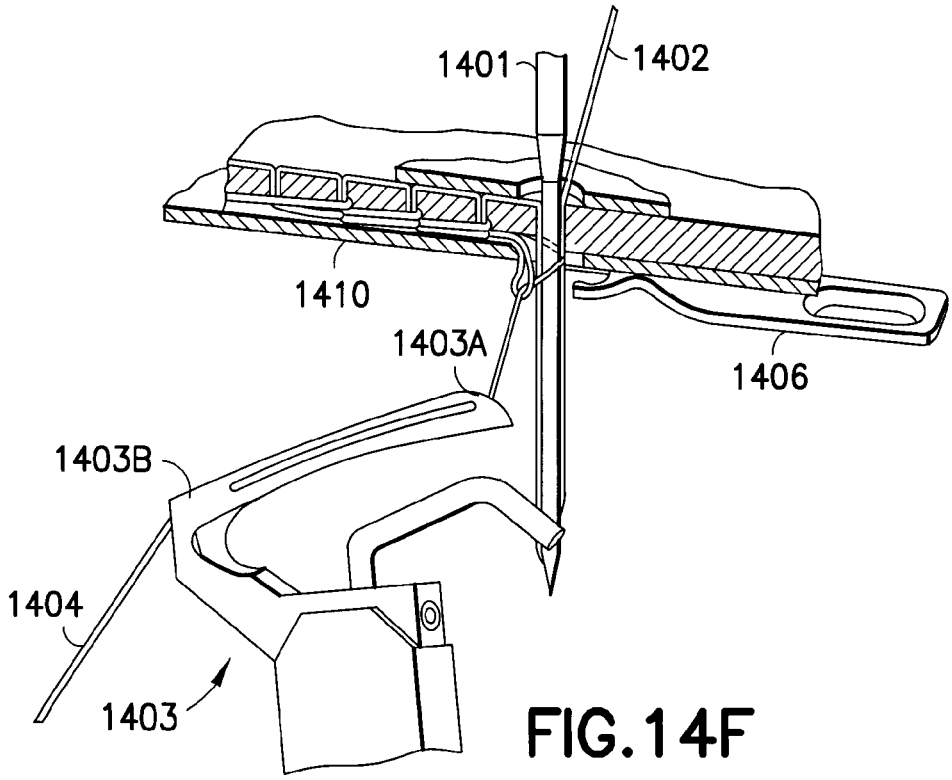
Figure 15:
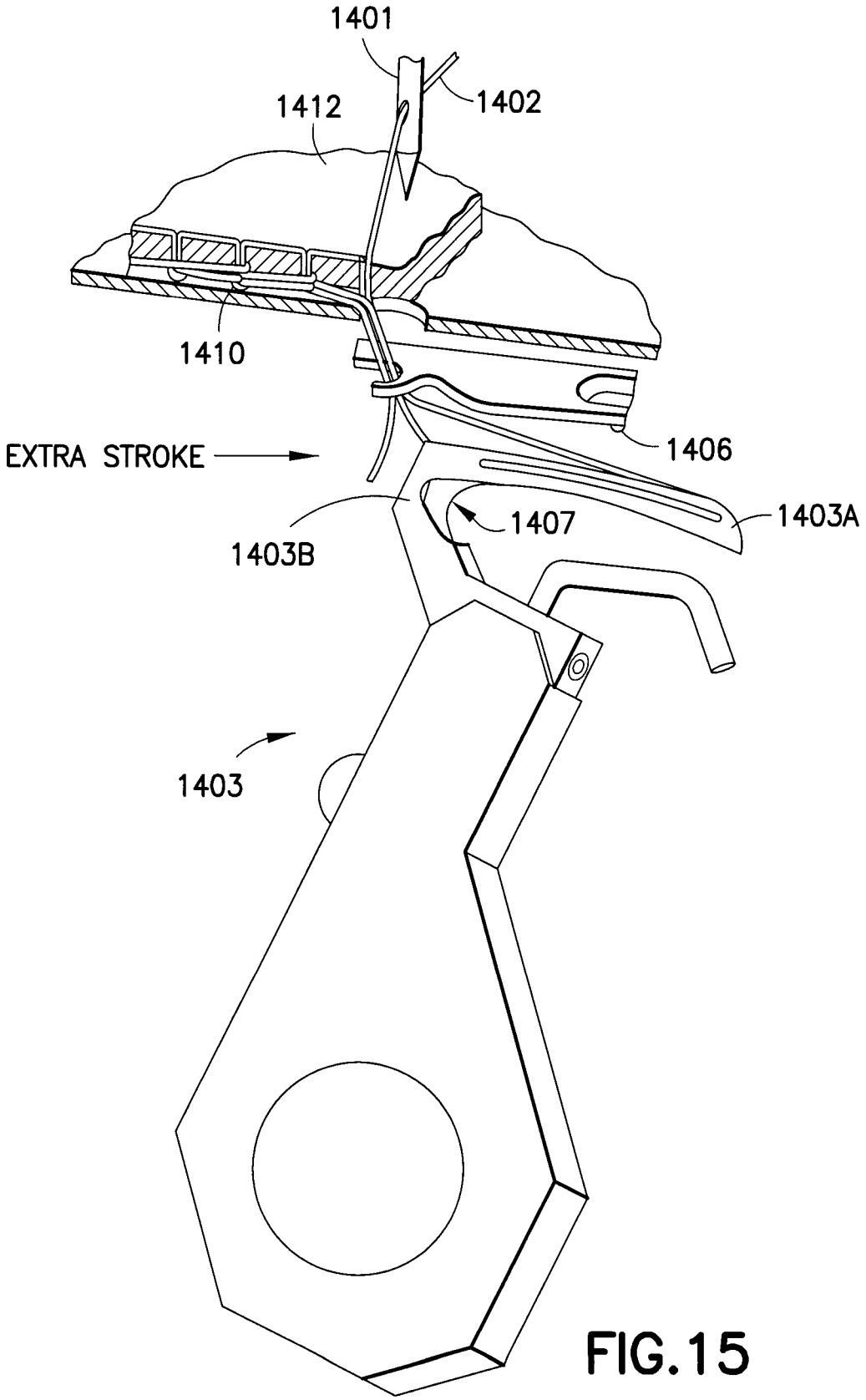
FIG. 15 shows a view of a looper (or hook) according to an embodiment of the present invention (in one example, the looper (or hook), as well as the phase, shown in this FIG. 15 may be utilized in connection with the machine shown in FIGS. 11-13).

With reference now to FIG. 15, the upper thread may be cut by blade 1407 with an extra hook stroke as described above (in one example, the movement phase shown in this FIG. 15 may follow the movement phase shown in FIG. 14A).

Figure 16:
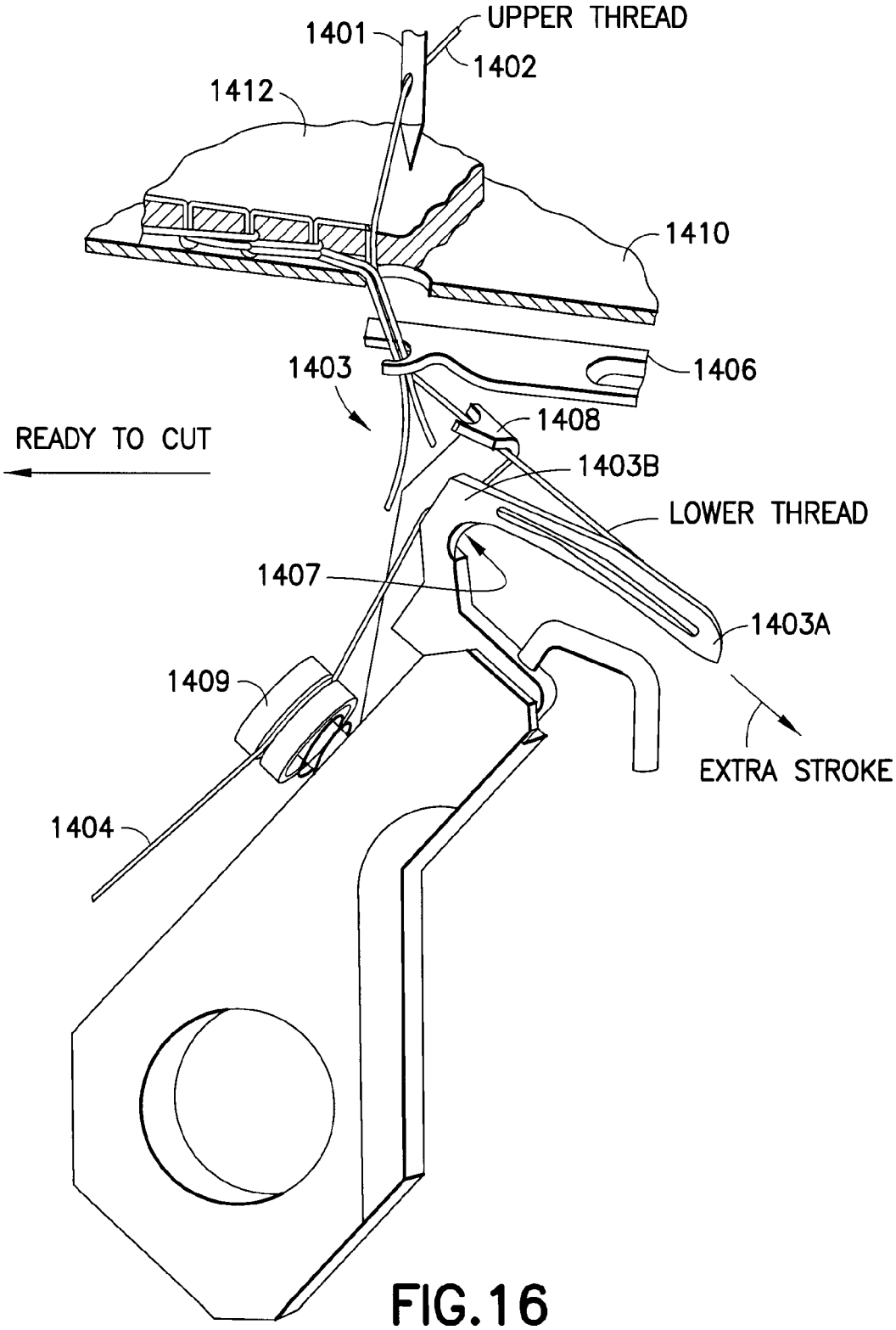
FIGS. 16-18 show various views of a looper (or hook) at various phases of movement according to an embodiment of the present invention (in one example, the looper (or hook), as well as the various phases, shown in these FIGS. 16-18 may be utilized in connection with the machine shown in FIGS. 11-13).

With reference now to FIG. 16, the lower thread may be cut by blade 1408 applied to the looper (or hook) in such a position that in the extra stroke phase it is located in the triangle of the lower thread ready to cut the lower thread when the looper (or hook) returns to its position to start sewing (see, e.g., FIG. 18) (in one example, the movement phase shown in this FIG. 16 may follow the movement phase shown in FIG. 15).

Figure 17:
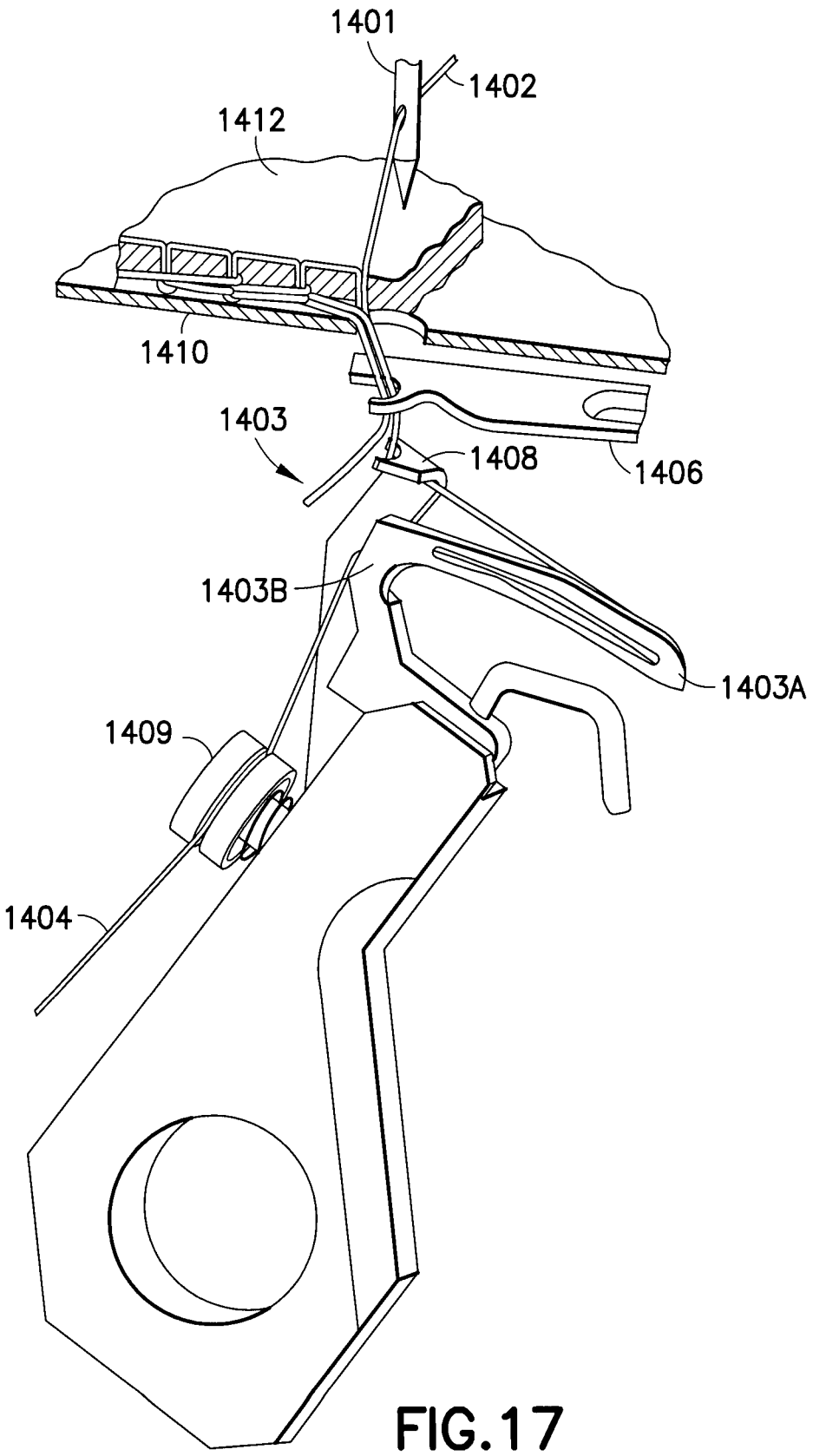
Figure 18:
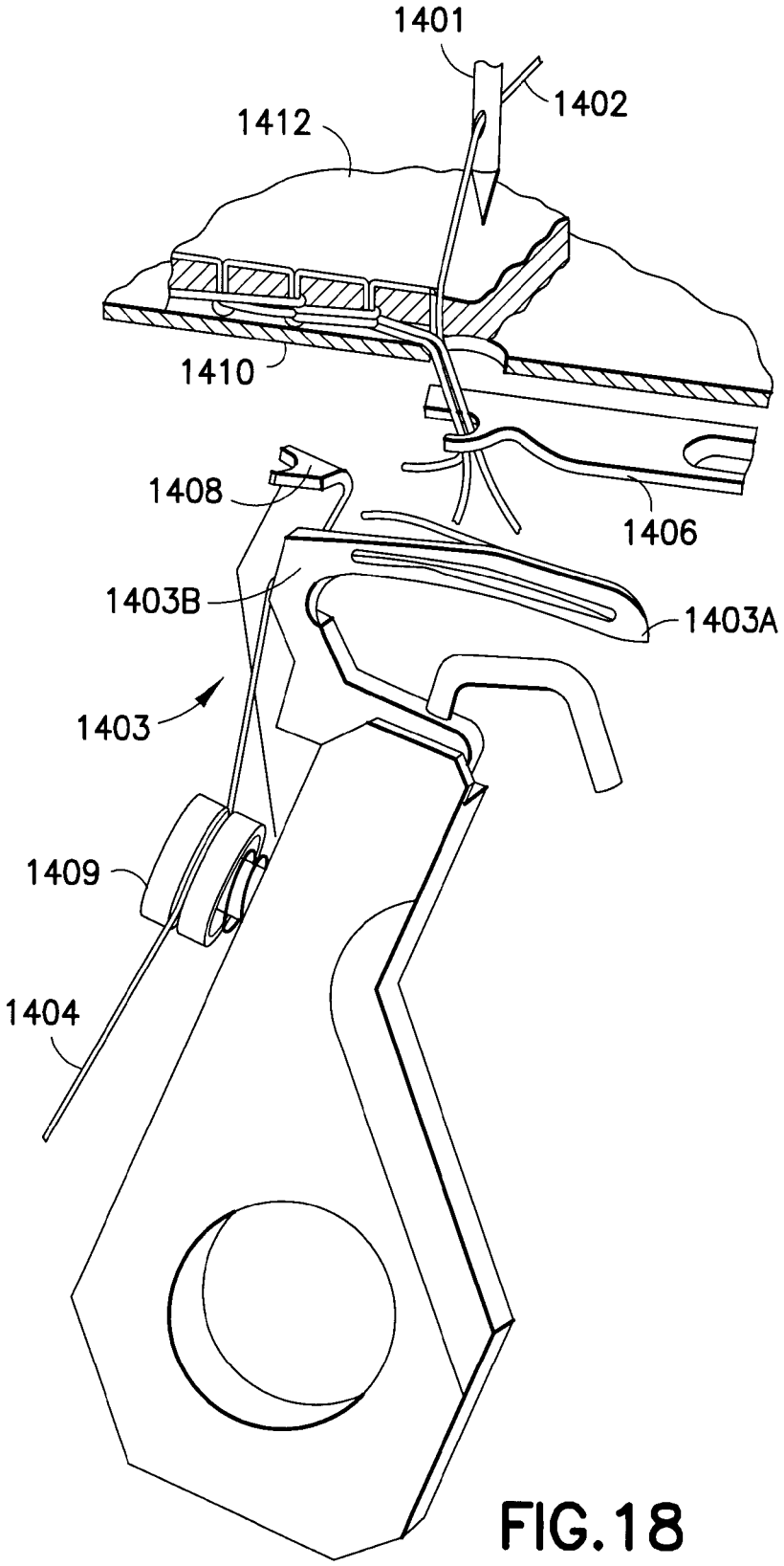
Figure 19A:
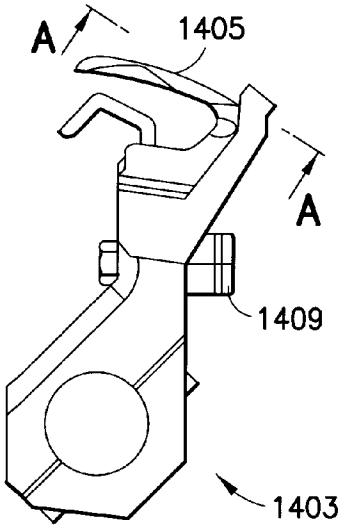
FIGS. 19A-19F show various side and top views of a looper (or hook) according to an embodiment of the present invention (in one example, the looper (or hook) shown in these FIGS. 19A-19F may be utilized in connection with the machine shown in FIGS. 11-13).
Figure 19B:
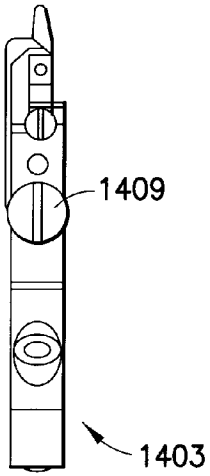
Figure 19C:
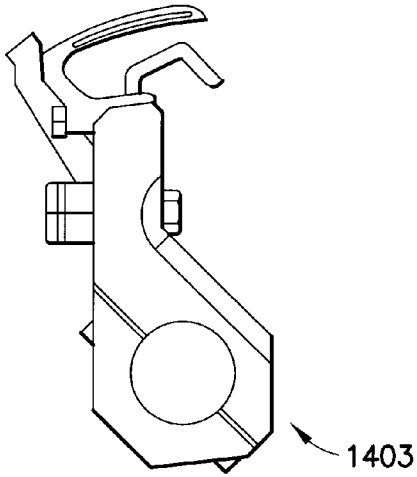
Figure 19D:
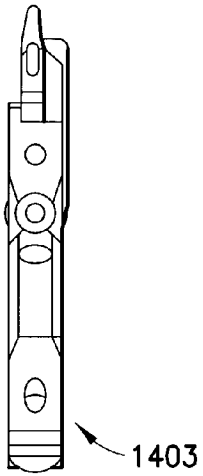
Figure 19E:
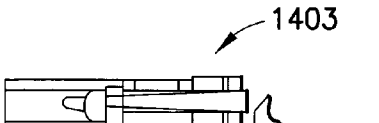
Figure 19F:
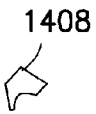
Figure 20:
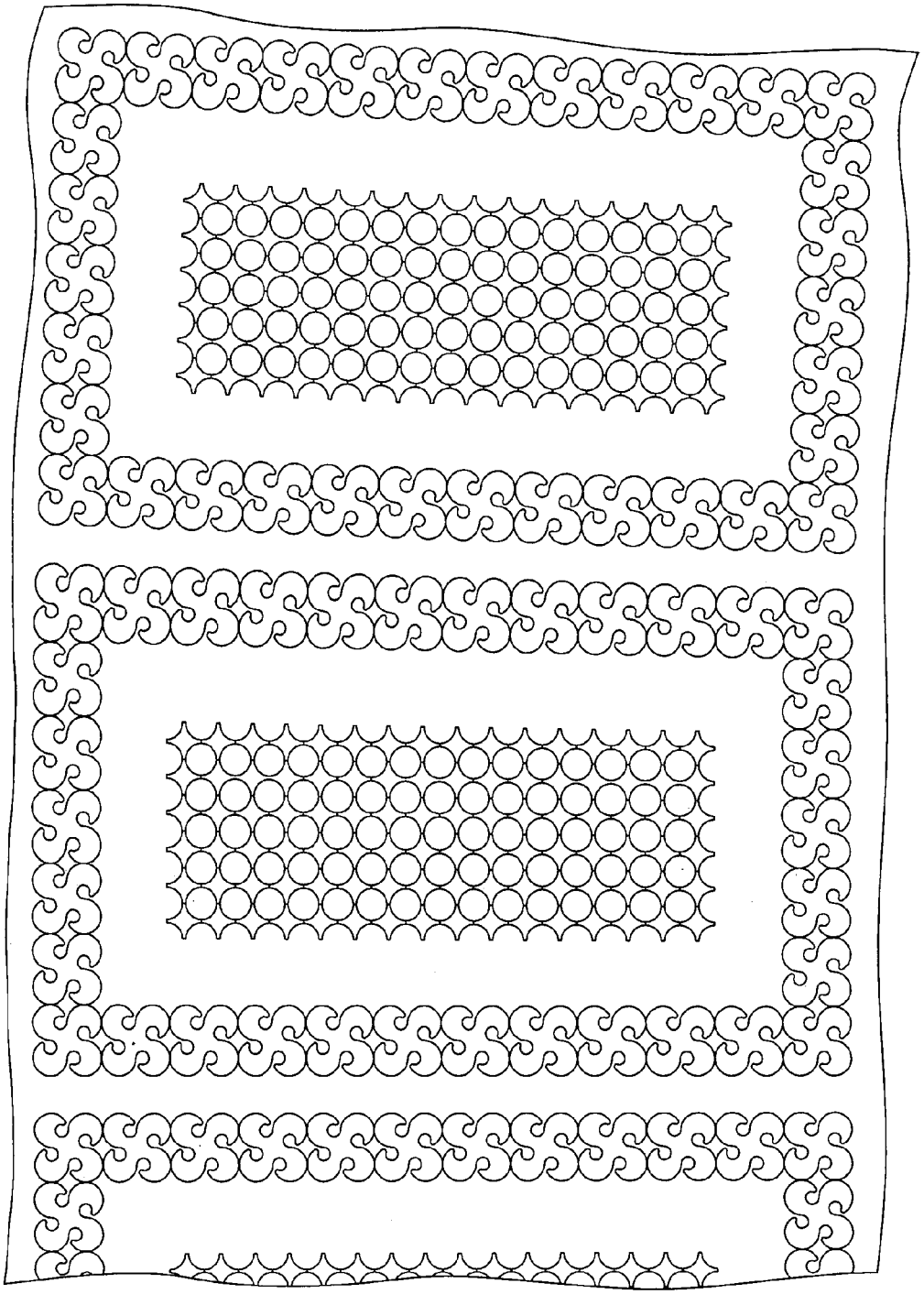
FIGS. 20-27 show views of various example patterns that may be produced using various embodiments of the present invention.
Figure 21:
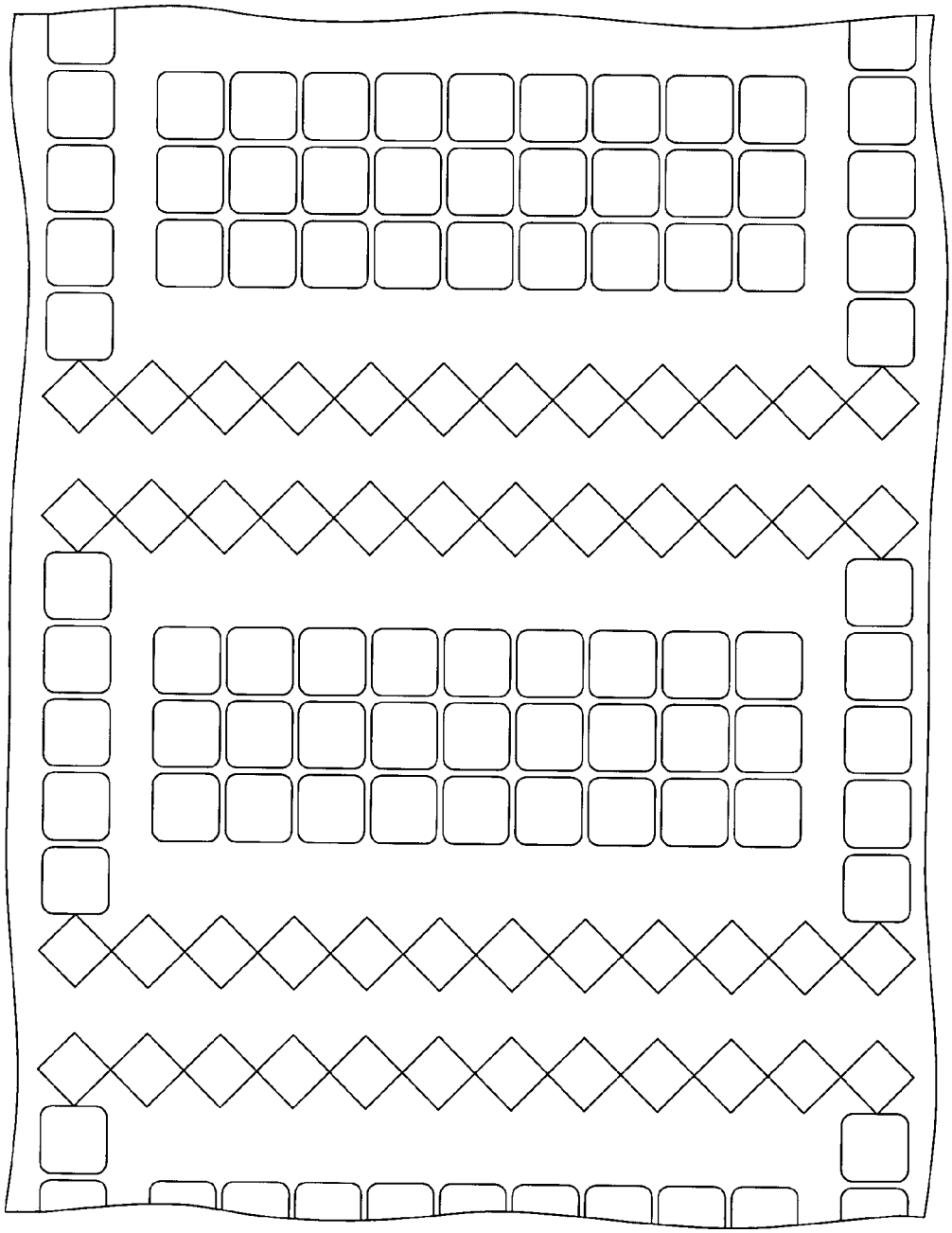
Figure 22:
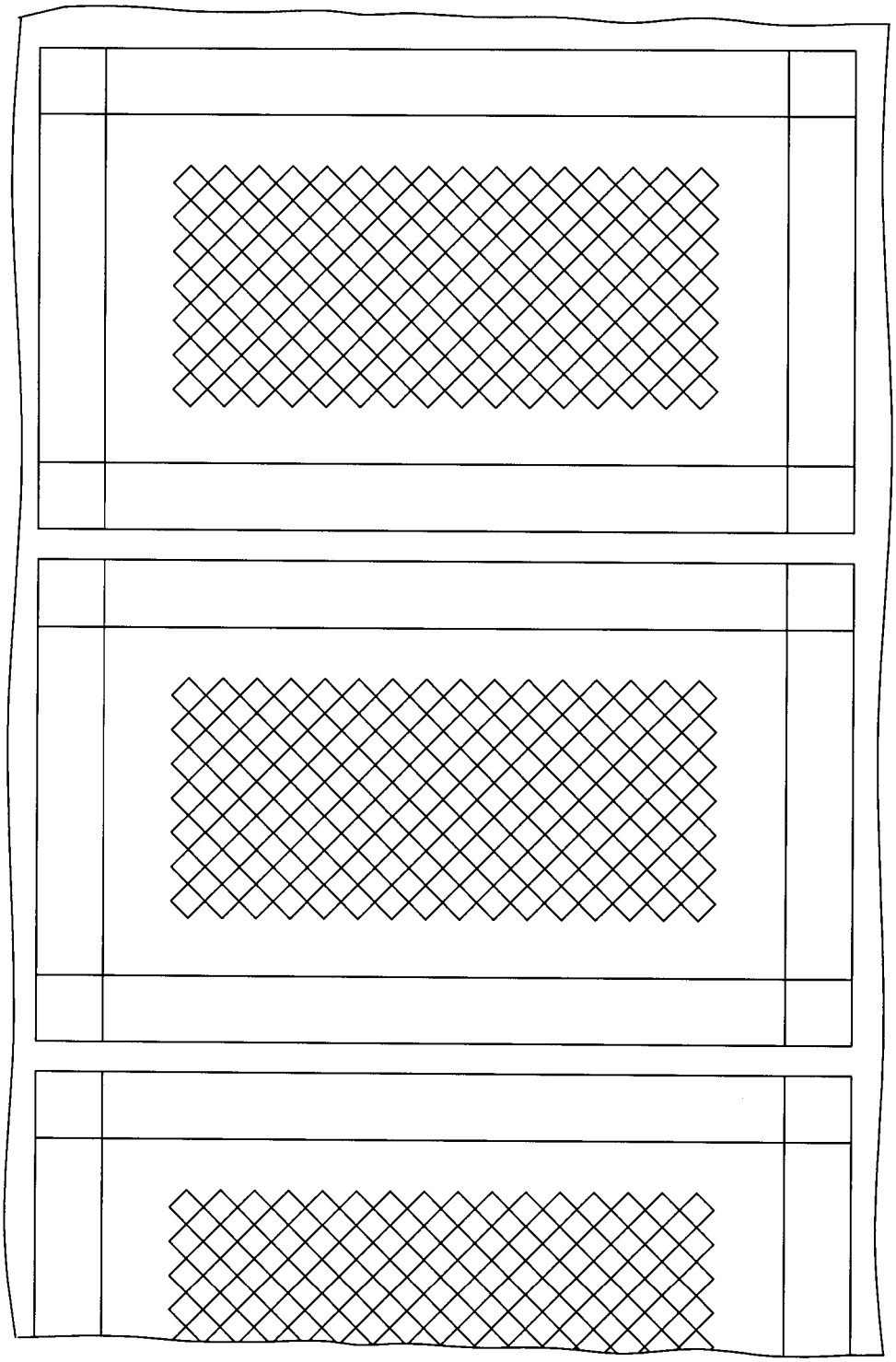
Figure 23:
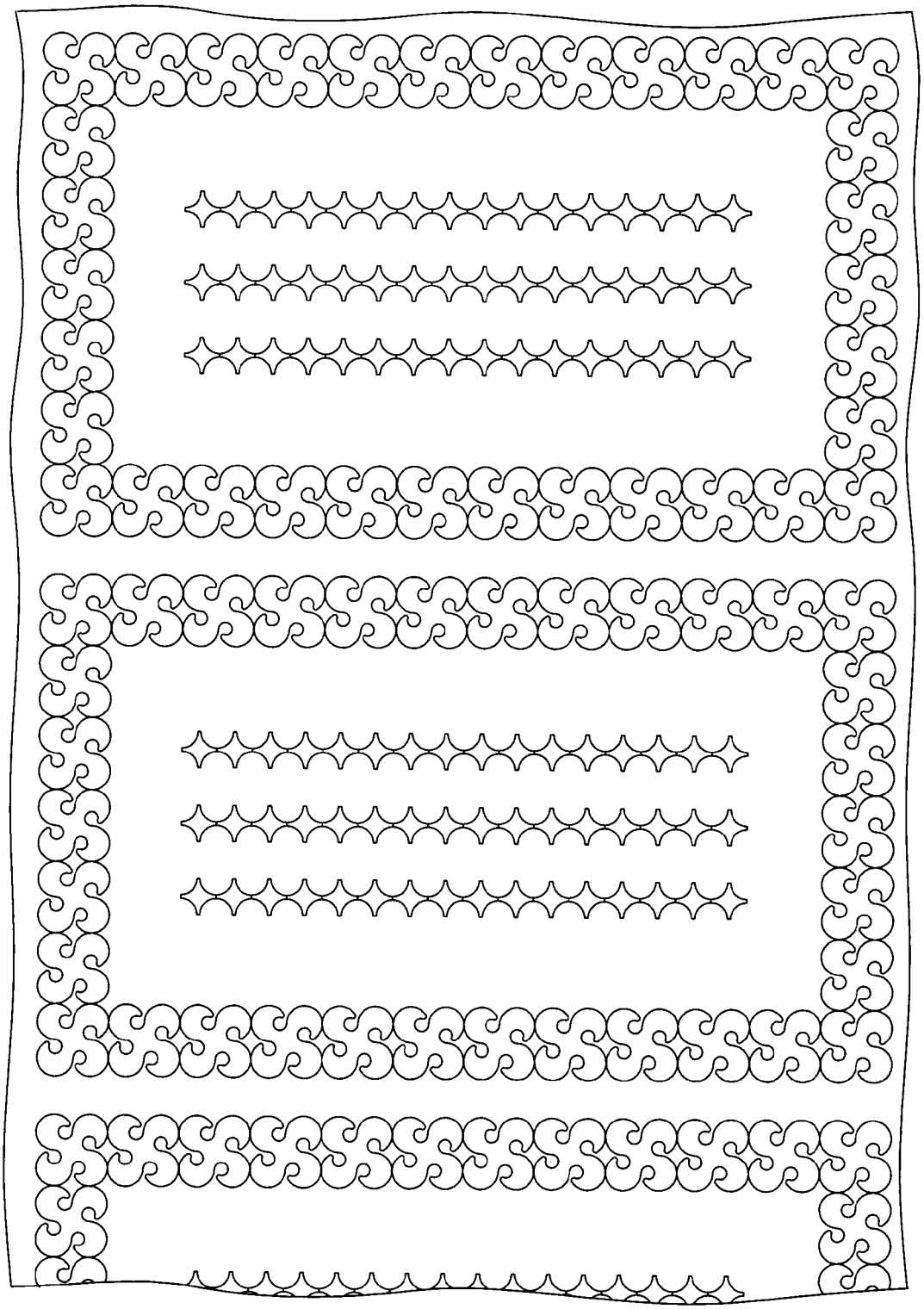
Figure 24:
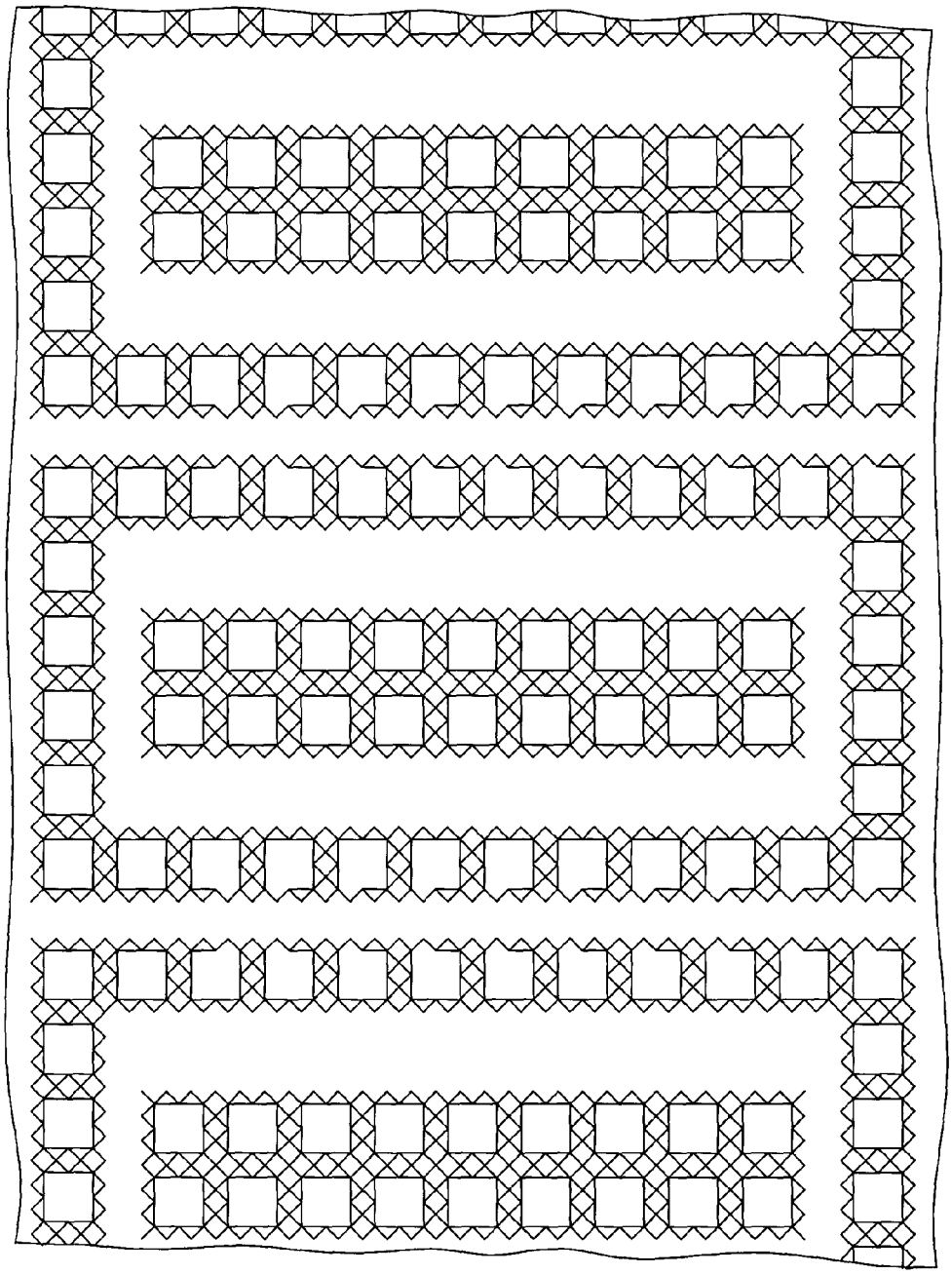
Figure 25:
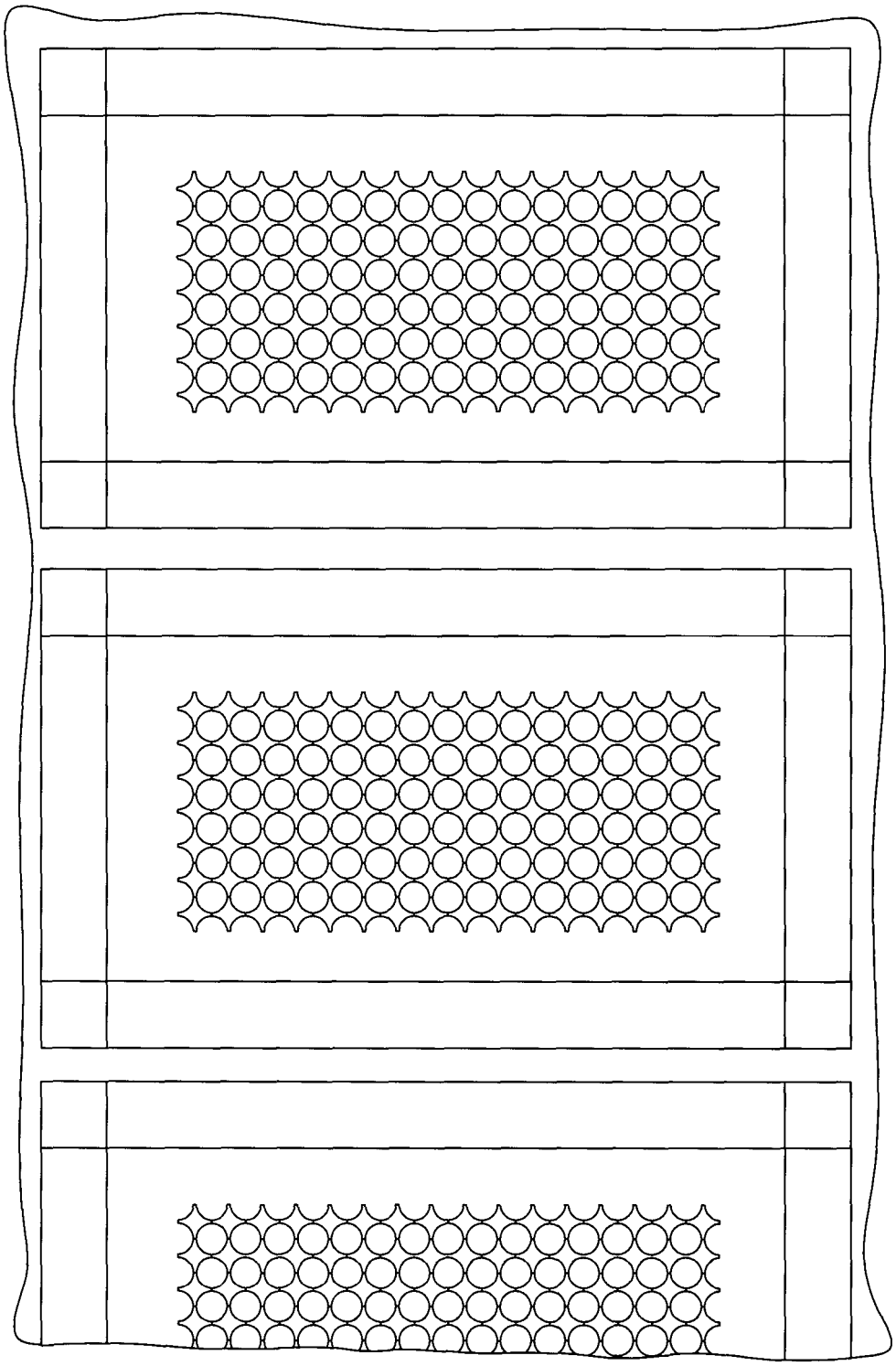
Figure 26:
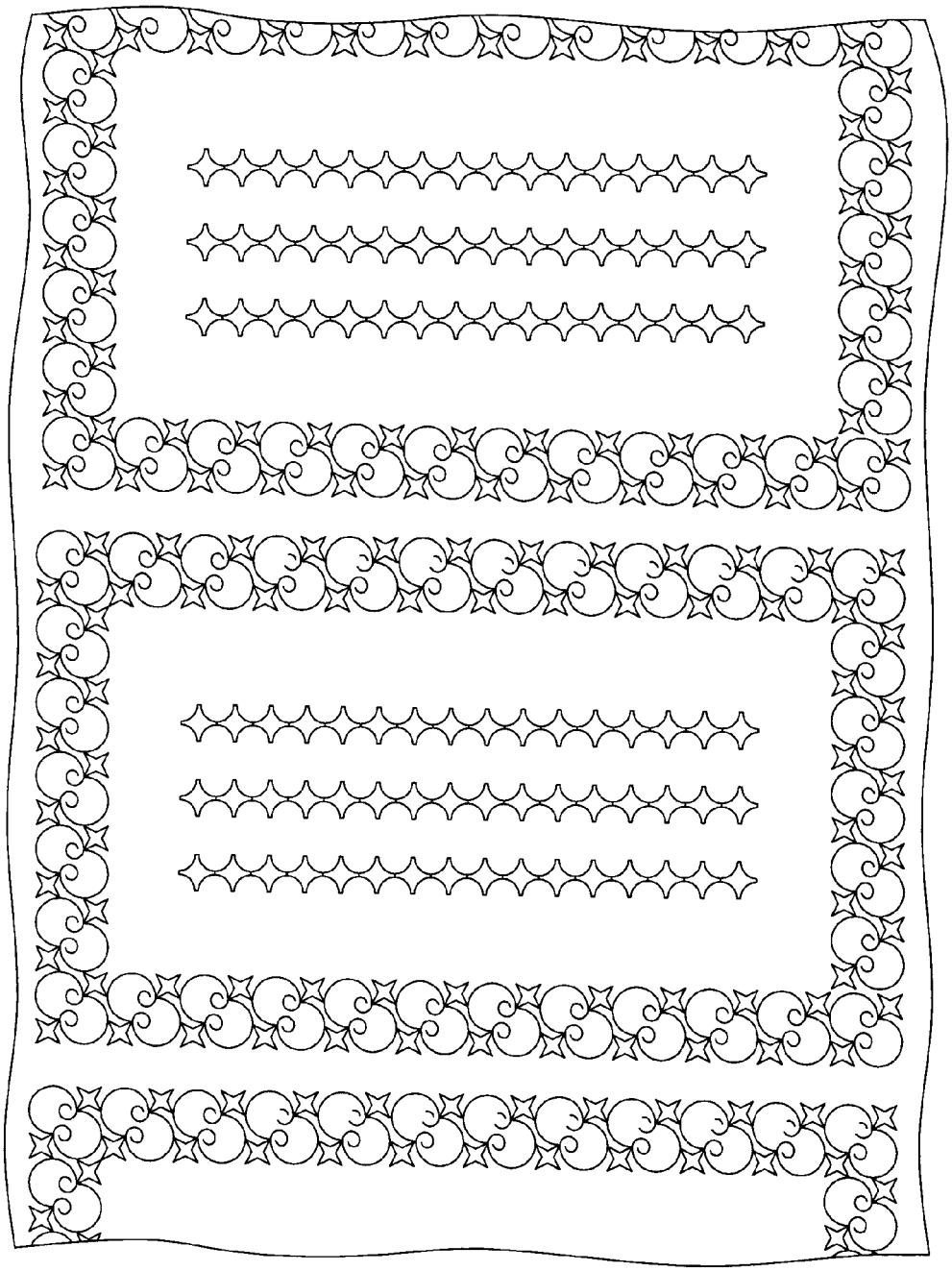
Figure 27:
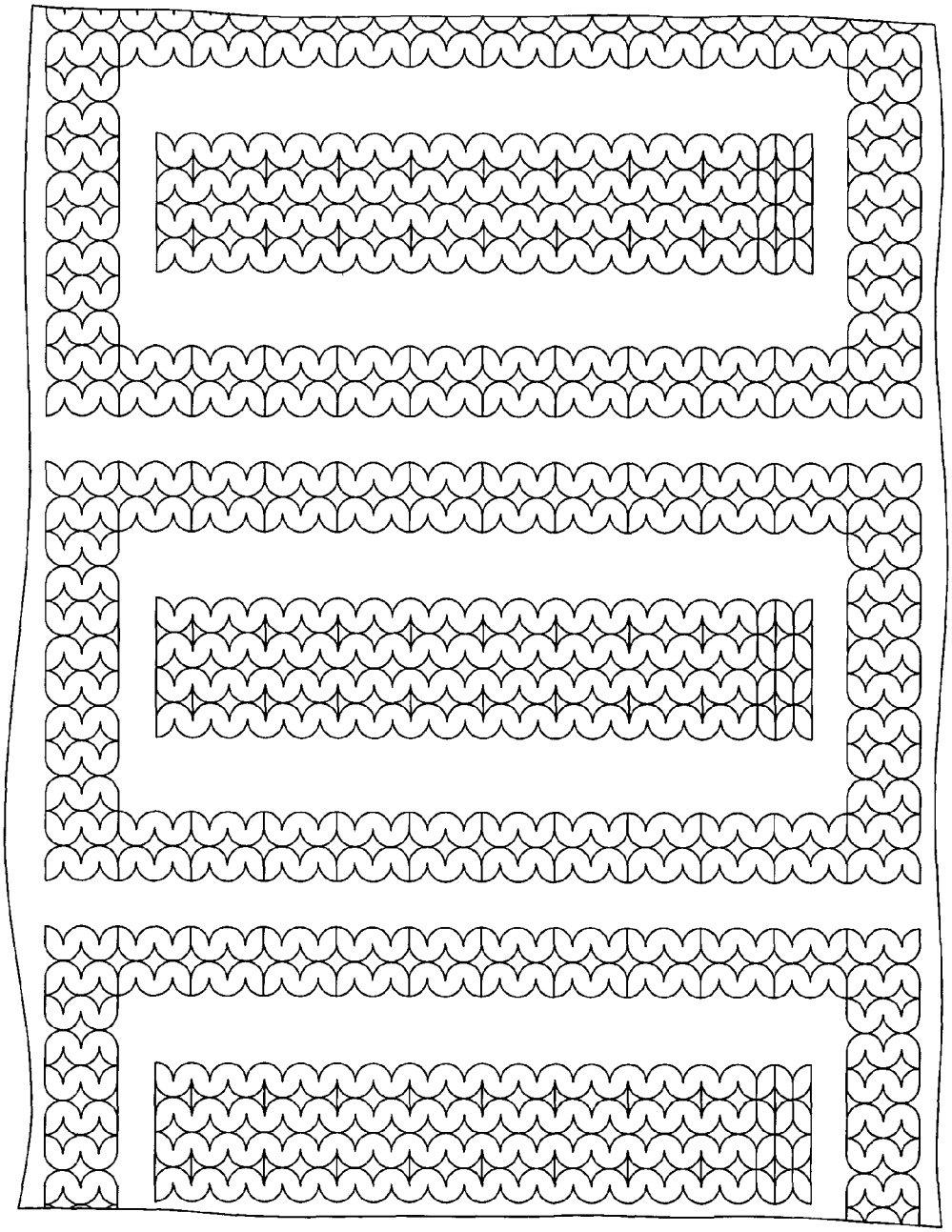
Figure 29:
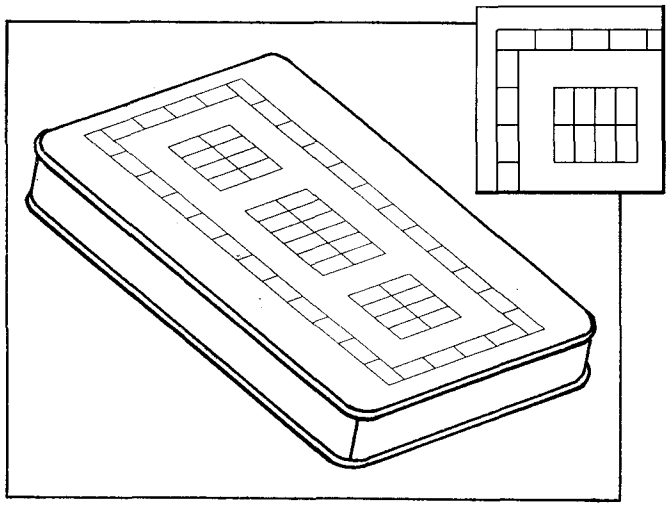
FIGS. 28-31 show views of additional various example patterns that may be produced using various embodiments of the present invention (each of these Figs. shows an example pattern on a mattress, along with a detail view of a portion of the associated pattern).
Figure 28:
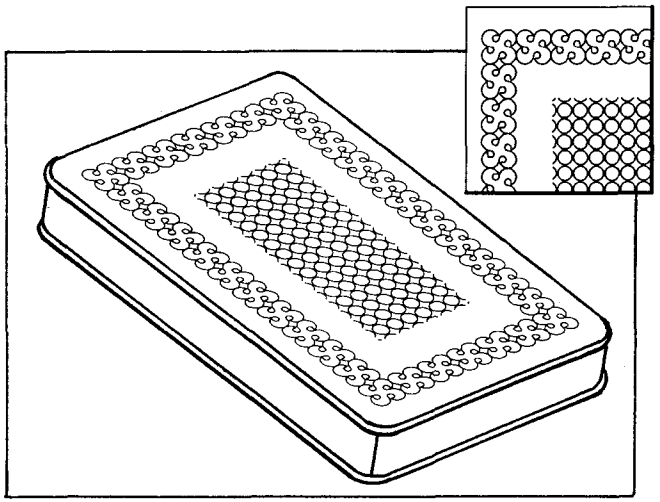
Figure 31:
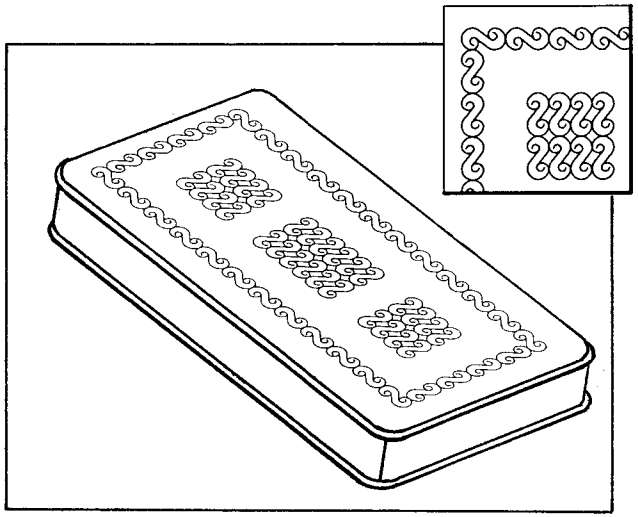
Figure 30:
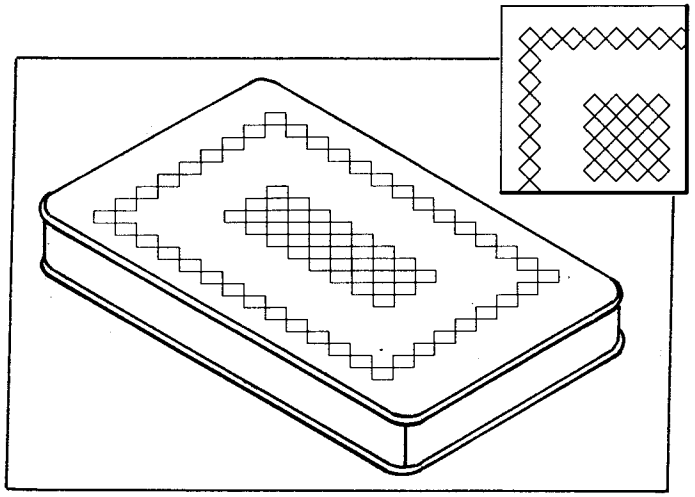
Figure 32:
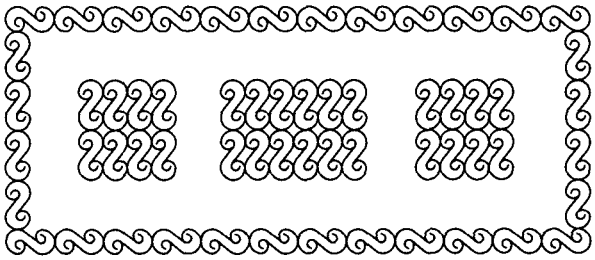
FIGS. 32-38 show views of additional various example patterns that may be produced using various embodiments of the present invention.
Figure 33:
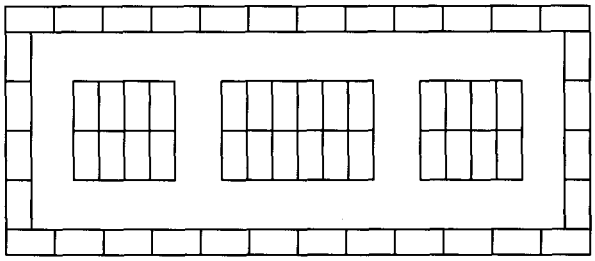
Figure 34:
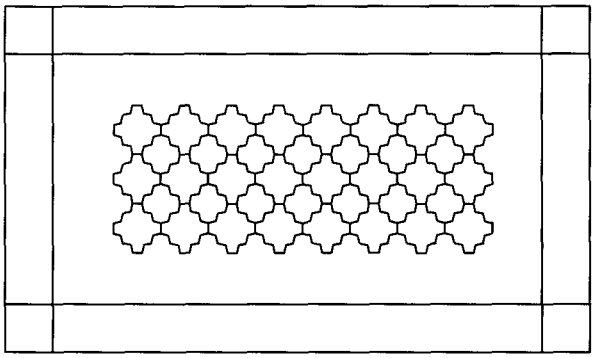
Figure 35:
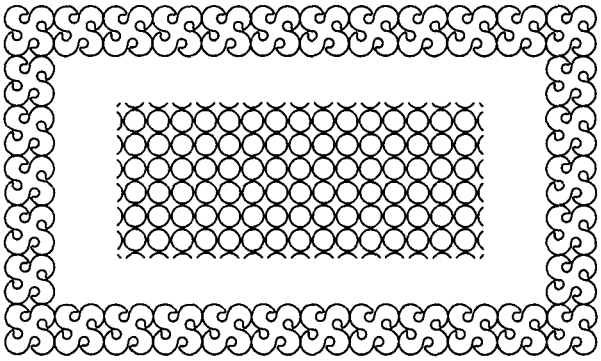
Figure 36:
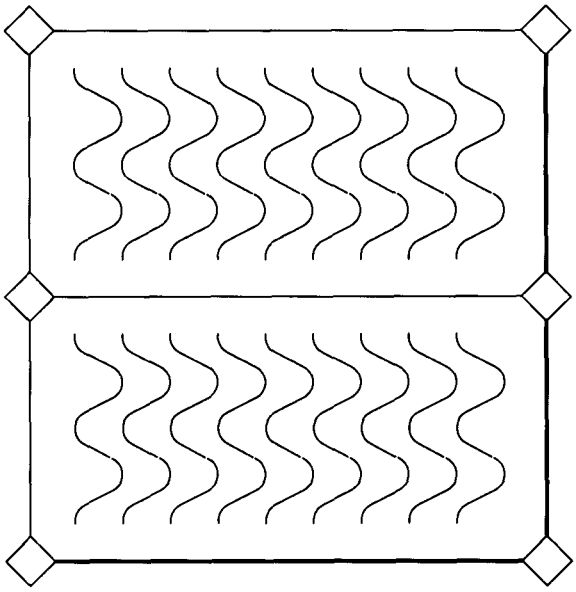
Figure 37:
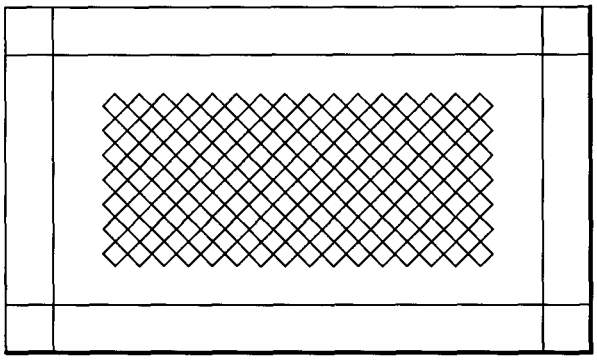
Figure 38:
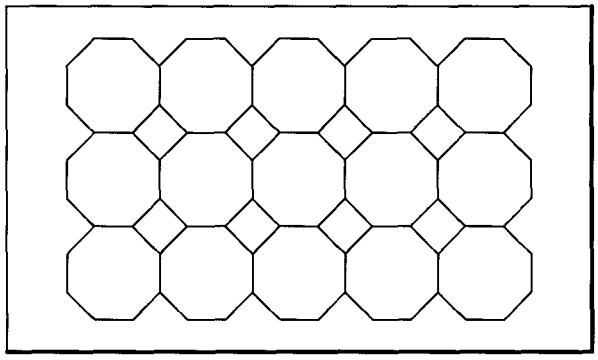
Figure 41:
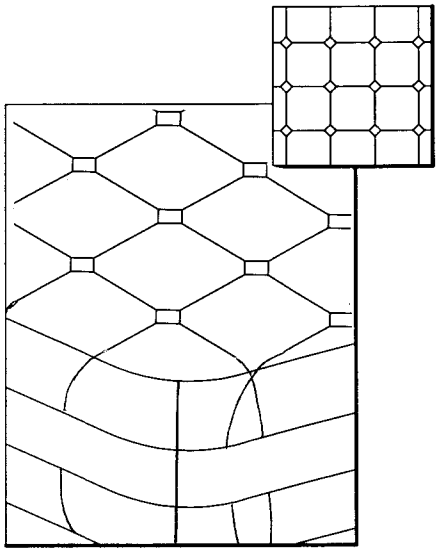
FIGS. 39-41 show views of additional various example patterns that may be produced using various embodiments of the present invention (each of these Figs. shows an example pattern on a mattress, along with a detail view of a portion of the associated pattern).
Figure 40:
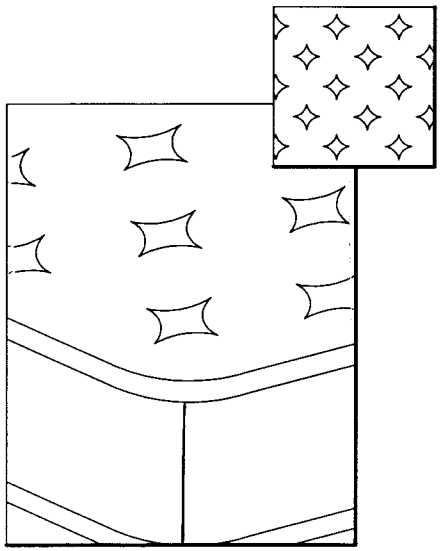
Figure 39:
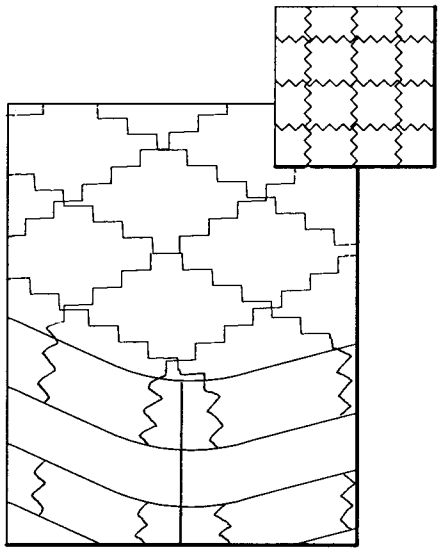
Figures 42, 43:
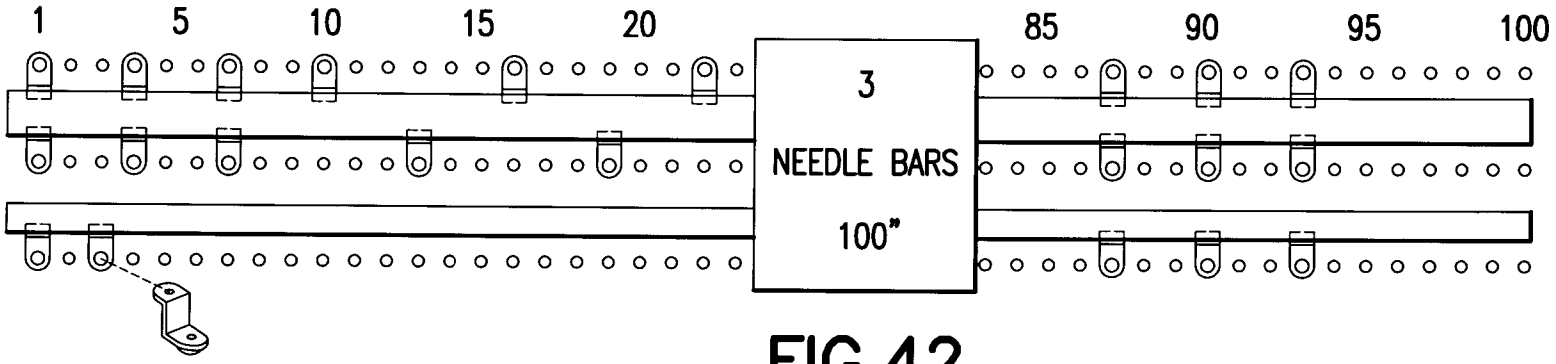
FIG. 42 shows an example configuration using three needle bars according to an embodiment of the present invention.
FIG. 43 shows an example configuration (in table format) using three needle bars according to an embodiment of the present invention.
Figure 44A:
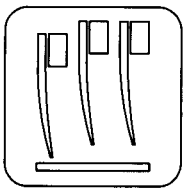
FIGS. 44A-44H show views of various example independent needle bar movement available using various embodiments of the present invention (each needle bar is shown end-on in these FIGS. 44A-44H, with each associated row of needles pointing downward).
Figure 44B:
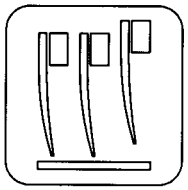
Figure 44C:
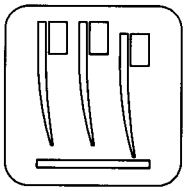
Figure 44D:
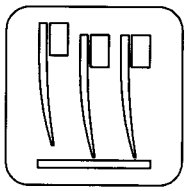
Figure 44E:
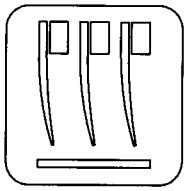
Figure 44F:
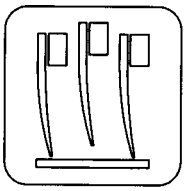
Figure 44G:
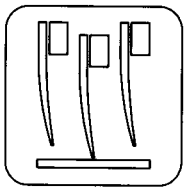
Figure 44H:
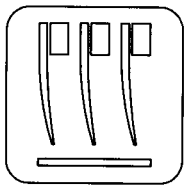

With reference now to FIG. 17, an intermediate phase of lower thread cutting preparation is shown (that is, a phase of movement between what is shown in FIG. 16 and what is shown in FIG. 18).

With reference now to FIG. 18, the phase of lower thread cutting is shown (in one example, the movement phase shown in this FIG. 18 may follow the movement phase shown in FIG. 17). This phase of FIG. 18 shows the tail of the lower cut thread cutting which may be important to start again further sewing. In one example, in the sequences of the multineedles for the quilting of isolated patterns (panel quilt), many or just a few loopers (or hooks) are engaged in the automatic cut of the superior (top or upper) and inferior (bottom or lower) thread and the tail of the inferior thread is not unthreaded during the not-working phase since it is retained by the small brake (thread tensioner or thread tensor) 1409.

With reference now to FIG. 19, various views of the assembly of a looper (or hook) with applied blade 1408 are shown (brake or thread tensor or thread tensioner 1409 is also shown).

In another embodiment a machine for making double chain stitches in a material (e.g., a fabric), the double chain stitches being made using at least one upper thread and at least one lower thread, is provided, comprising: at least one needle (see, e.g., needle 1401 of FIGS. 14A-14F and FIGS. 15-18) bringing the at least one upper thread (see, e.g., upper thread 1402 of FIGS. 14A-14F and FIGS. 15-18) from above the material to below the material (see, e.g., material 1412 of FIGS. 14A-14F and FIGS. 15-18); and at least one looper (see, e.g., looper 1403 of FIGS. 14A-14F and FIGS. 15-18) disposed below the material; wherein the looper manipulates the lower thread (see, e.g., lower thread 1404 of FIGS. 14A-14F and FIGS. 15-18) to form double chain stitches in combination with the upper thread; and wherein the looper comprises at least one cutting element (see, e.g., cutting element 1408 of FIGS. 16-18) configured to cut the lower thread.

In one example, the material may be disposed adjacent a work surface (see, e.g., work surface 1410 of FIGS. 14A-14F and FIGS. 15-18). In one specific example, the material may be disposed above a work surface. In another specific example, the material may be disposed below a work surface.

In another example, the needle may oscillate (e.g., up and down and/or in an arc) as the needle brings the upper thread from above the material to below the material.

In another example, the looper may oscillate (e.g., in an arc) as the looper manipulates the lower thread to form double chain stitches in combination with the upper thread.

In another example, the cutting element may comprise a knife edge.

In another example, the cutting element may comprise a blunt edge.

In another example, the looper may comprise a leading end (see, e.g., leading end 1403A of FIGS. 14A-14F and FIGS. 15-18) extending from a neck portion (see, e.g., neck portion 1403B of FIGS. 14A-14F and FIGS. 15-18), and the cutting element of the looper may be disposed in a direction extending from the neck away from the leading end.

In another example, the cutting element of the looper may be disposed in a direction extending approximately 180 degrees away from the leading end.

In another example, the cutting element may be attached to the looper.

In another example, the cutting element may be integral with the looper.

In another embodiment a method for making double chain stitches in a material (e.g., a fabric), the double chain stitches being made using at least one upper thread and at least one lower thread, is provided, comprising: providing the material (see, e.g., material 1412 of FIGS. 14A-14F and FIGS. 15-18) to receive the double chain stitches; utilizing at least one needle (see, e.g., needle 1401 of FIGS. 14A-14F and FIGS. 15-18) to bring the upper thread (see, e.g., upper thread 1402 of FIGS. 14A-14F and FIGS. 15-18) from above the material to below the material; utilizing at least one looper (see, e.g., looper 1403 of FIGS. 14A-14F and FIGS. 15-18) disposed below the material to manipulate the lower thread (see, e.g., lower thread 1404 of FIGS. 14A-14F and FIGS. 15-18) to form double chain stitches in combination with the upper thread; and utilizing the at least one looper to cut the lower thread with at least one cutting element (see, e.g., cutting element 1408 of FIGS. 16-18) associated with the at least one looper.

In one example, the material may be disposed adjacent a work surface (see, e.g., work surface 1410 of FIGS. 14A-14F and FIGS. 15-18). In one specific example, the material may be disposed above a work surface. In another specific example, the material may be disposed below a work surface.

In another example, the needle may oscillate (e.g., up and down and/or in an arc) as the needle brings the upper thread from above the material to below the material.

In another example, the looper may oscillate (e.g., in an arc) as the looper manipulates the lower thread to form double chain stitches in combination with the upper thread.

In another example, the cutting element may comprise a knife edge.

In another example, the cutting element may comprise a blunt edge.

In another example, the looper may comprise a leading end (see, e.g., leading end 1403A of FIGS. 14A-14F and FIGS. 15-18) extending from a neck portion (see, e.g., neck portion 1403B of FIGS. 14A-14F and FIGS. 15-18), and the cutting element of the looper may be disposed in a direction extending from the neck away from the leading end.

In another example, the cutting element of the looper may be disposed in a direction extending approximately 180 degrees away from the leading end.

In another example, the cutting element may be attached to the looper.

In another example, the cutting element may be integral with the looper.

In another embodiment a machine for making double chain stitches in a material (e.g., a fabric), the double chain stitches being made using a plurality of upper threads and a plurality of lower threads, is provided, comprising: a plurality of needles (see, e.g., needle 1401 of FIGS. 14A-14F and FIGS. 15-18), each needle bringing one of the upper threads (see, e.g., upper thread 1402 of FIGS. 14A-14F and FIGS. 15-18) from above the material to below the material; and a plurality of loopers (see, e.g., looper 1403 of FIGS. 14A-14F and FIGS. 15-18) disposed below the material; wherein each looper manipulates one of the lower threads (see, e.g., lower thread 1404 of FIGS. 14A-14F and FIGS. 15-18) to form double chain stitches in combination with a respective one of the upper threads; and wherein each looper comprises at least one cutting element (see, e.g., cutting element 1408 of FIGS. 16-18) configured to cut the respective lower thread.

In one example, the material may be disposed adjacent a work surface (see, e.g., work surface 1410 of FIGS. 14A-14F and FIGS. 15-18). In one specific example, the material may be disposed above a work surface. In another specific example, the material may be disposed below a work surface.

In another example, each of the needles may oscillate (e.g., up and down and/or in an arc) as each of the needles brings the respective upper thread from above the material to below the material.

In another example, each of the loopers may oscillate (e.g., in an arc) as each of the loopers manipulates the respective lower thread to form double chain stitches in combination with the respective upper thread.

In another example, each cutting element may comprise a knife edge.

In another example, each cutting element may comprise a blunt edge.

In another example, each of the loopers may comprises a leading end (see, e.g., leading end 1403A of FIGS. 14A-14F and FIGS. 15-18) extending from a neck portion (see, e.g., neck portion 1403B of FIGS. 14A-14F and FIGS. 15-18), and the cutting element of each of the loopers may be disposed in a direction extending from the neck away from the leading end.

In another example, the cutting element of each of the loopers may be disposed in a direction extending approximately 180 degrees away from the leading end.

In another example, the cutting element of each of the loppers may be attached to each of the loopers.

In another example, the cutting element of each of the loopers may be integral with each of the loopers.

In another embodiment a method for making double chain stitches in a material (e.g., a fabric), the double chain stitches being made using a plurality of upper threads and a plurality of lower threads, is provided, comprising: providing the material (see, e.g., material 1412 of FIGS. 14A-14F and FIGS. 15-18) to receive the double chain stitches; utilizing a plurality of needles (see, e.g., needle 1403A of FIGS. 14A-14F and FIGS. 15-18), each needle bringing one of the upper threads (see, e.g., upper thread 1402 of FIGS. 14A-14F and FIGS. 15-18) from above the material to below the material; utilizing a plurality of loopers (see, e.g., looper 1403 of FIGS. 14A-14F and FIGS. 15-18) disposed below the material, wherein each looper is used to manipulate one of the lower threads (see, e.g., lower thread 1404 of FIGS. 14A-14F and FIGS. 15-18) to form double chain stitches in combination with a respective one of the upper threads; and utilizing the plurality of loopers to cut each respective lower thread with at least one cutting element (see, e.g., cutting element 1408 of FIGS. 16-18) associated with each of the loopers.

In one example, the material may be disposed adjacent a work surface (see, e.g., work surface 1410 of FIGS. 14A-14F and FIGS. 15-18). In one specific example, the material may be disposed above a work surface. In another specific example, the material may be disposed below a work surface.

In another example, each of the needles may oscillate (e.g., up and down and/or in an arc) as each of the needles brings the respective upper thread from above the material to below the material.

In another example, each of the loopers may oscillate (e.g., in an arc) as each of the loopers manipulates the respective lower thread to form double chain stitches in combination with the respective upper thread.

In another example, each cutting element may comprise a knife edge.

In another example, each cutting element may comprise a blunt edge.

In another example, each of the loopers may comprises a leading end (see, e.g., leading end 1403A of FIGS. 14A-14F and FIGS. 15-18) extending from a neck portion (see, e.g., neck portion 1403B of FIGS. 14A-14F and FIGS. 15-18), and the cutting element of each of the loopers may be disposed in a direction extending from the neck away from the leading end.

In another example, the cutting element of each of the loopers may be disposed in a direction extending approximately 180 degrees away from the leading end.

In another example, the cutting element of each of the loppers may be attached to each of the loopers.

In another example, the cutting element of each of the loopers may be integral with each of the loopers.

As described herein, various embodiments of the present invention may provide for a double chain stitch automatic quilting machine for cutting the superior (top or upper) and/or inferior (bottom or lower) thread. Various embodiments of the present invention may solve the problem of a floating lower thread (which, left uncut such as in the case of pattern link drawings, may conventionally create trouble).

In one specific example, a disclosed mechanism for automatic cutting of thread (e.g., lower thread and/or upper thread) may be combined with a disclosed mechanism for independent needle bar movement (e.g., three independent needle bars)—e.g., to permit the making of various desired patterns.

In another example, the present invention may be applied (e.g., as a machine and/or method) to a single needle machine or method.

As described herein, various embodiments of the present invention relate to a double chain stitch quilting machine.

In one example, the double chain stitch quilting machine may be capable of working up to 1,400 s.p.m.

In another example, movement is simplified and the number of mechanical parts needed are reduced.

In another example, a pretension system may be provided.

In another example, various 360 degree continuous pattern (s) may be stitched (e.g., at very high productivity) using various embodiments of the present invention.

In another example, production (e.g., stitching) of panel quilt pattern(s) that may be essentially impossible to produce in an essentially continuous manner by other means may be provided.

In another example, various pattern-link drawings may be stitched using various embodiments of the present invention.

In another example, various embodiments of the present invention may be used to operate on elastic knitted materials.

In another example, various embodiments of the present invention may provide for one or more of the following: independent presser feet (e.g., instead of a traditional presser plate); independent needle bars (e.g., with oscillating movements); dynamic and constant pretension of the materials; and/or real-time control of the yarn's tension (and/or of the thread's tension).

In another example, three independent needle bars may be utilized.

In another example, various embodiments of the present invention may be used to operate on one or more of the following: mattress; bed cover; and/or bed spread.

In another example, various standard quilting, 360 degree decorative patterns, and/or pattern-link movement may be produced using a single highly productive, flexible and efficient sewing system using various embodiments of the present invention.

In another example, a fully integrated computerized control system may be provided.

In another example, material of any desired thickness may be operated on (e.g., up to 2" foam plus 200 gr wadding).

In another example, various embodiments of the present invention may provide for any desired type of sewing, quilting, embroidery and/or the like.

In another example, high precision control of carriage and rolls may provide for one or more of the following: precision in 360 degree patterns; no skipped stitches in any direction; use of thin needles (e.g., 130/160); and or quilting of extra heavy or very thin filling materials.

In another example, a number of fixed looper positions (e.g., 100 fixed looper positions) may be provided (e.g., to accept any desired needle set and avoid a long down time to move and set the loopers at new positions).

In another example, independent positive presser feet (e.g., instead of a traditional presser plate) may provide for one or more of the following: presser feet only correspond to position of needles; very tight stitches; and/or more quilting thickness and puff effect.

In another example, a 90 degree looper bars reversing system may be provided (e.g., which may allow easy and fast looper threading operation).

In another example, bartack and jump (e.g., with an automatic top thread cutting system essentially assuring zero tail on top surface) may be provided.

In another example, an upper thread feeder with yo-yo action may be provided (e.g., such upper thread feeder with yo-yo action may, thanks to its progressive pulling action, allow a stronger closing of stitches without stressing the top threads (as compared, for example, to a traditional butterfly system)—thus avoiding thread breaks.

In another example, stop motion action may be provided for needles and/or loopers (this may allow, for example, visual control of the tension of every thread). In another example, the stop motion action may be integrated into software.

In another example, a working speed may be up to 1,400 spm.

In another example, a pattern range may be 360 degrees.

In another example, a carriage stroke may be 12" (305 mm).

In another example, there may be no theoretical limit in back sewing.

In another example, equalized stitch length in all directions may be provided.

In another example, there may be a three needle bar configuration as follows: 1"×3"×6".

In another example, a multi-roll material handing system may be provided.

In another example, stitch length may be ⅙ mm.

For the purposes of this disclosure, a computer readable medium is a medium that stores computer data in machine readable form. By way of example, and not limitation, a computer readable medium can comprise computer storage media as well as communication media, methods or signals. Computer storage media includes volatile and non-volatile, removable and non-removable media implemented in any method or technology for storage of information such as computer-readable instructions, data structures, program modules or other data. Computer storage media includes, but is not limited to, RAM, ROM, EPROM, EEPROM, flash memory or other solid state memory technology; CD-ROM, DVD, or other optical storage; cassettes, tape, disk, or other magnetic storage devices; or any other medium which can be used to tangibly store the desired information and which can be accessed by the computer.

Further, the present invention may, of course, be implemented using any appropriate computer readable medium, computer hardware and/or computer software.

As mentioned, the techniques described herein may, of course, be computer implemented and may utilize any appropriate computer hardware and/or computer software. In this regard, those of ordinary skill in the art are well versed in the type of computer hardware that may be used (e.g., a personal computer ("PC"), a network (e.g., an intranet and/or the Internet)), the type of computer programming techniques that may be used, and the type of computer programming languages that may be used. The aforementioned examples are, of course, illustrative and not restrictive.

Of course, any embodiment/example described herein (or any feature or features of any embodiment/example described herein) may be combined with any other embodiment/example described herein (or any feature or features of any such other embodiment/example described herein).

While a number of embodiments of the present invention have been described, it is understood that these embodiments are illustrative only, and not restrictive, and that many modifications may become apparent to those of ordinary skill in the art. For example, any desired number and/or type of motors(s) may be utilized (e.g., electric AC motor(s); electric DC motors(s); electric stepper motor(s); electric induction motor (s); electric linear motor(s); electric actuators (e.g., linear actuator(s)); piston(s) (hydraulic and/or pneumatic)). Further still, any desired number of needle(s) may be used on any desired number of needle bar(s). Further still, any desired number of arm(s) may be used on any given needle bar (e.g., multiple arms for each needle bar). Further still, any desired number of arm(s) may be used on any given rotating rod (e.g., multiple arms for each rotating rod). Further still, any desired number of rotating rod(s) may be utilized. Further still, any desired number of hooks(s) may be utilized. Further still, any desired number of presser feet may be utilized. Further still, any reciprocation described herein may be, for example, a back-and-forth oscillation. Further still, any rotation described herein may be, for example, a back-and-forth rotation or a rotation in one direction only. Further still, the various steps may be carried out in any desired order (and any desired steps may be added and/or any desired steps may be eliminated).

What is claimed is:

1. A machine for making double chain stitches in a material, the double chain stitches being made using at least one upper thread and at least one lower thread, the machine comprising:

at least one needle bar a plurality of needles, wherein the needle bar has attached thereto the plurality of needles and wherein each needle brings the at least one upper thread from above the material to below the material; and at least one arm wherein the arm having a first end and a second end, the first end of the arm being connected to a drive train and the second end of the arm having attached thereto the needle bar;

wherein the arm is sufficiently designed such that the second end of the arm moves along a path forming an arc; and wherein each of the plurality of needles is elongated along a long axis and wherein each of the plurality of needles is curved along the long axis.

2. The machine of claim 1, wherein each needle oscillate as each needle brings the upper thread from above the material to below the material.

3. The machine of claim 1 further comprising:

a plurality of loopers disposed below the material sufficiently designed to manipulate the lower thread to form double chain stitches in combination with the upper thread;

wherein each looper sufficiently designed to cut the lower thread with at least one cutting element associated with each looper; and wherein each looper oscillates as the looper manipulates the lower thread to form double chain stitches in combination with the upper thread.

4. The machine of claim 1, wherein the cutting element comprises a knife edge.

5. The machine of claim 1, wherein the looper comprises a leading end extending from a neck portion, and wherein the cutting element of the looper is disposed in a direction extending from the neck away from the leading end.

6. The machine of claim 5, wherein the cutting element of the looper is disposed in a direction extending approximately 180 degrees away from the leading end.

7. The machine of claim 1, wherein the cutting element is attached to the looper.

8. The machine of claim 1, wherein the cutting element is integral with the looper.

9. The machine of claim 1 further including at least a first and second needle bar, wherein each needle bar is independently moved.

* * * * *